US012234119B2

(12) United States Patent
Yoshita

(10) Patent No.: US 12,234,119 B2
(45) Date of Patent: Feb. 25, 2025

(54) MEDIUM CONVEYING APPARATUS TO CORRECT SKEW OF MEDIUM USING SECOND ROLLER WHILE MOVING FIRST ROLLER TO BE SPACED APART FROM MEDIUM

(71) Applicant: PFU LIMITED, Kahoku (JP)

(72) Inventor: Shogo Yoshita, Kahoku (JP)

(73) Assignee: PFU LIMITED, Kahoku (JP)

( * ) Notice: Subject to any disclaimer, the term of this patent is extended or adjusted under 35 U.S.C. 154(b) by 121 days.

(21) Appl. No.: 17/643,382

(22) Filed: Dec. 8, 2021

(65) Prior Publication Data

US 2022/0234856 A1 Jul. 28, 2022

(30) Foreign Application Priority Data

Jan. 22, 2021 (JP) ..... 2021-008739

(51) Int. Cl.
*B65H 9/00* (2006.01)
*B65H 1/04* (2006.01)
(Continued)

(52) U.S. Cl.
CPC ..... *B65H 9/002* (2013.01); *B65H 1/04* (2013.01); *B65H 3/0684* (2013.01); *B65H 7/08* (2013.01);
(Continued)

(58) Field of Classification Search
CPC ..... B65H 1/04; B65H 3/06; B65H 3/0669; B65H 3/0684; B65H 7/06; B65H 7/08;
(Continued)

(56) References Cited

U.S. PATENT DOCUMENTS 5,203,552 A * 4/1993 Hoshi ..... G03G 15/6508 271/9.01
5,918,876 A * 7/1999 Maruyama ..... B65H 5/062 271/274

(Continued)

FOREIGN PATENT DOCUMENTS

JP 2013-147300 A 8/2013
JP 2019-048692 A 3/2019
JP 2019-137498 A 8/2019

OTHER PUBLICATIONS

Japanese Office Action dated Sep. 24, 2024 regarding Japanese Patent Application No. 2021-008739 corresponding to U.S. Appl. No. 17/643,382 (5 pages) with English Translation (9 pages).

*Primary Examiner* — Prasad V Gokhale
(74) *Attorney, Agent, or Firm* — LEWIS ROCA ROTHGERBER CHRISTIE LLP

(57) ABSTRACT

A medium conveying apparatus includes a first roller to convey a medium, a movement mechanism to move the first roller between a first position in contact with the medium and a second position spaced apart from the medium, a second roller located on a downstream side of the first roller in a medium conveying direction to convey the medium, and a processor to detect a skew of the conveyed medium, and control the movement mechanism to move the first roller to the second position, and correct the skew of the medium using the second roller when the skew of the medium is detected.

20 Claims, 17 Drawing Sheets

(51) Int. Cl.

| | |
|---|---|
| ***B65H 3/06*** | (2006.01) |
| ***B65H 7/08*** | (2006.01) |
| ***B65H 7/18*** | (2006.01) |
| ***B65H 7/20*** | (2006.01) |
| ***B65H 9/18*** | (2006.01) |

(52) U.S. Cl.
CPC ..... *B65H 7/18* (2013.01); *B65H 7/20* (2013.01); *B65H 9/18* (2013.01); *B65H 2301/331* (2013.01); *B65H 2553/40* (2013.01); *B65H 2553/51* (2013.01)

(58) Field of Classification Search
CPC . B65H 7/14; B65H 7/18; B65H 9/002; B65H 2301/331; B65H 2511/214; B65H 2511/216; B65H 2553/416; B65H 2553/51
See application file for complete search history.

(56) References Cited

U.S. PATENT DOCUMENTS

| | | | | |
|---|---|---|---|---|
| 6,089,561 | A * | 7/2000 | Marshall | B65H 7/02 271/111 |
| 2008/0036137 | A1* | 2/2008 | Moteki | B65H 9/002 271/228 |
| 2015/0246786 | A1* | 9/2015 | Staehli | B65H 9/002 198/412 |
| 2018/0273319 | A1* | 9/2018 | Hasegawa | B65H 9/002 |
| 2019/0079445 | A1 | 3/2019 | Wakabayashi | |
| 2019/0241384 | A1 | 8/2019 | Terao | |

* cited by examiner

MEDIUM CONVEYING APPARATUS TO CORRECT SKEW OF MEDIUM USING SECOND ROLLER WHILE MOVING FIRST ROLLER TO BE SPACED APART FROM MEDIUM

CROSS-REFERENCE TO RELATED APPLICATIONS

This application is based upon and claims the benefit of priority of prior Japanese Patent Application No. 2021-008739, filed on Jan. 22, 2021, the entire contents of which are incorporated herein by reference.

TECHNICAL FIELD

Embodiments discussed in the present specification relate to medium conveyance.

BACKGROUND

In a medium conveying apparatus such as a scanner, a skew (oblique motion) in which a medium is conveyed in an inclined manner may occur. When the skew (oblique motion) of the medium occurs, the medium conveying apparatus is required to appropriately correct the skew of the medium since the medium may abut a side wall of a conveyance path and a jam (paper jam) of the medium may occur.

A sheet conveying apparatus having a conveying roller located along a width direction of a sheet conveyance path, and a pressing member to press a sheet to the conveying roller, is disclosed (Japanese Unexamined Patent Publication (Kokai) No. 2013-147300). The sheet conveying apparatus has a pair of resist rollers to correct the skew by forming a loop in the sheet by a front end of the conveyed sheet abutting on the resist rollers, and controls to release the pressing member from being pressed to the conveying roller when a predetermined time elapses after the sheet starts forming the loop.

SUMMARY

According to some embodiments, a medium conveying apparatus includes a first roller to convey a medium, a movement mechanism to move the first roller between a first position in contact with the medium and a second position spaced apart from the medium, a second roller located on a downstream side of the first roller in a medium conveying direction to convey the medium, and a processor to detect a skew of the conveyed medium, and control the movement mechanism to move the first roller to the second position, and correct the skew of the medium using the second roller when the skew of the medium is detected.

According to some embodiments, a method for correcting a skew of a medium, includes, conveying the medium, by a first roller, moving the first roller between a first position in contact with the medium and a second position spaced apart from the medium, by a movement mechanism, conveying the medium, by a second roller located on a downstream side of the first roller in a medium conveying direction, detecting the skew of the conveyed medium, and controlling the movement mechanism to move the first roller to the second position, and correcting the skew of the medium using the second roller when the skew of the medium is detected.

According to some embodiments, a computer-readable, non-transitory medium stores a computer program. The computer program causes a medium conveying apparatus including a first roller to convey a medium, a movement mechanism to move the first roller between a first position in contact with the medium and a second position spaced apart from the medium, a second roller located on a downstream side of the first roller in a medium conveying direction to convey the medium, to execute a process including detecting the skew of the conveyed medium, and controlling the movement mechanism to move the first roller to the second position, and correcting the skew of the medium using the second roller when the skew of the medium is detected.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus, a method for correcting a skew of a medium, and a computer-readable, non-transitory medium storing a computer program according to an embodiment, will be described with reference to the drawings. However, it should be noted that the technical scope of the invention is not limited to these embodiments, and extends to the inventions described in the claims and their equivalents.

Figure 1:
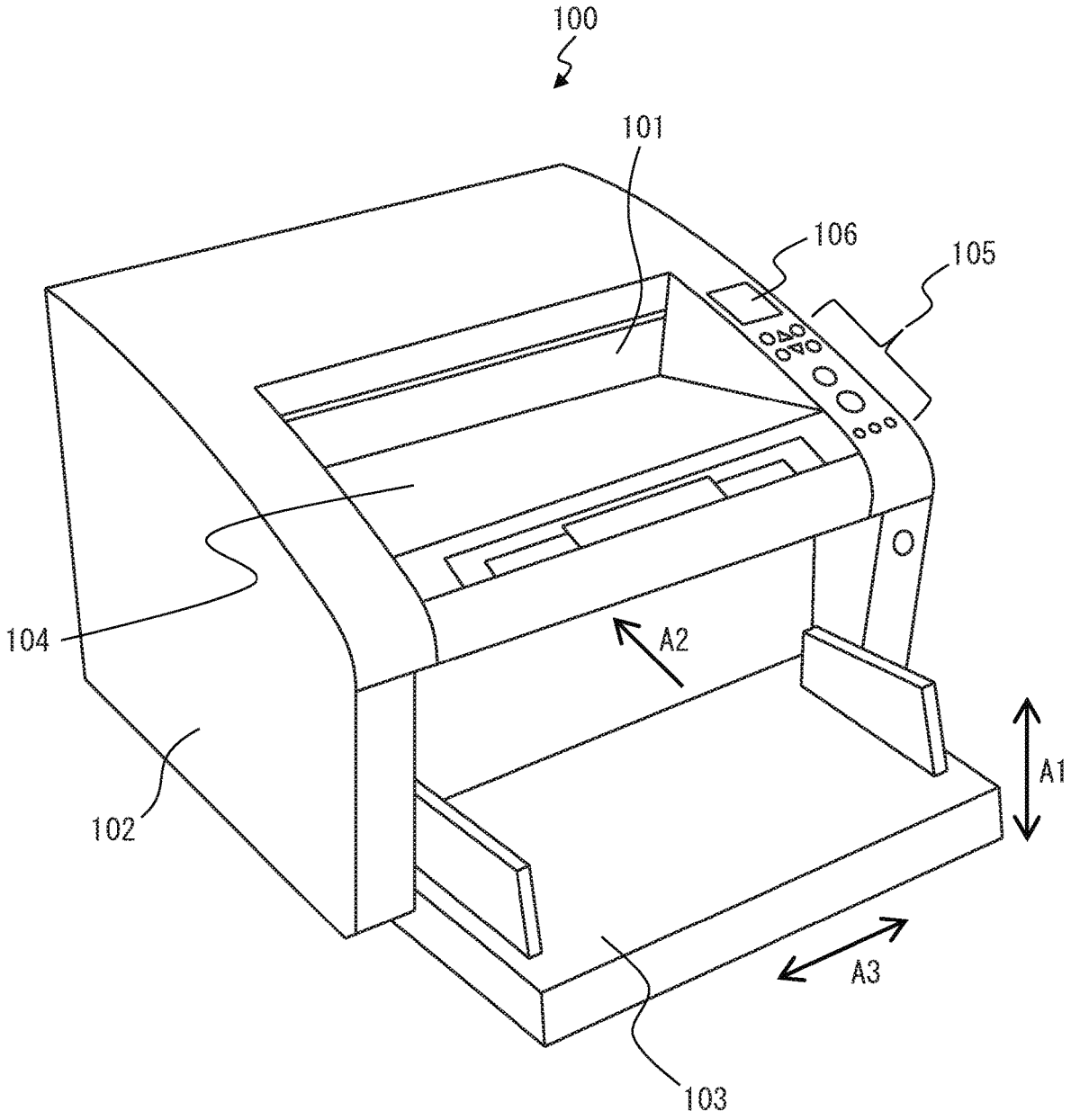
FIG. 1 is a perspective view illustrating a medium conveying apparatus 100.

FIG. 1 is a perspective view illustrating a medium conveying apparatus 100 configured as an image scanner. The medium conveying apparatus 100 conveys and images a medium being a document. The medium is a paper, a thick paper, a card, etc. The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

The media conveying device 100 includes a first housing 101, a second housing 102, a medium tray 103, an ejection tray 104, an operation device 105 and a display device 106, etc.

The first housing 101 is located on an upper side of the medium conveying apparatus 100 and is engaged with the second housing 102 by hinges so as to be opened and closed at a time of medium jam, during cleaning the inside of the medium conveying apparatus 100, etc.

The medium tray 103 is engaged with the second housing 102 in such a way as to be able to place a medium to be conveyed. The medium tray 103 is provided on a side surface of the second housing 102 on a medium supply side to be movable in a substantially vertical direction (height direction) A1. The ejection tray 104 is a tray formed on the first housing 101 capable of holding the ejected medium, to load the ejected medium.

The operation device 105 includes an input device such as a button, and an interface circuit acquiring a signal from the input device, receives an input operation by a user, and outputs an operation signal based on the input operation by the user. The display device 106 includes a display including a liquid crystal or organic electro-luminescence (EL), and an interface circuit for outputting image data to the display, and displays the image data on the display.

In FIG. 1, an arrow A2 indicates a medium conveying direction, and an arrow A3 indicates a width direction perpendicular to the medium conveying direction. Hereinafter, an upstream refers to an upstream in the medium conveying direction A2, and a downstream refers to a downstream in the medium conveying direction A2.

Figure 2:
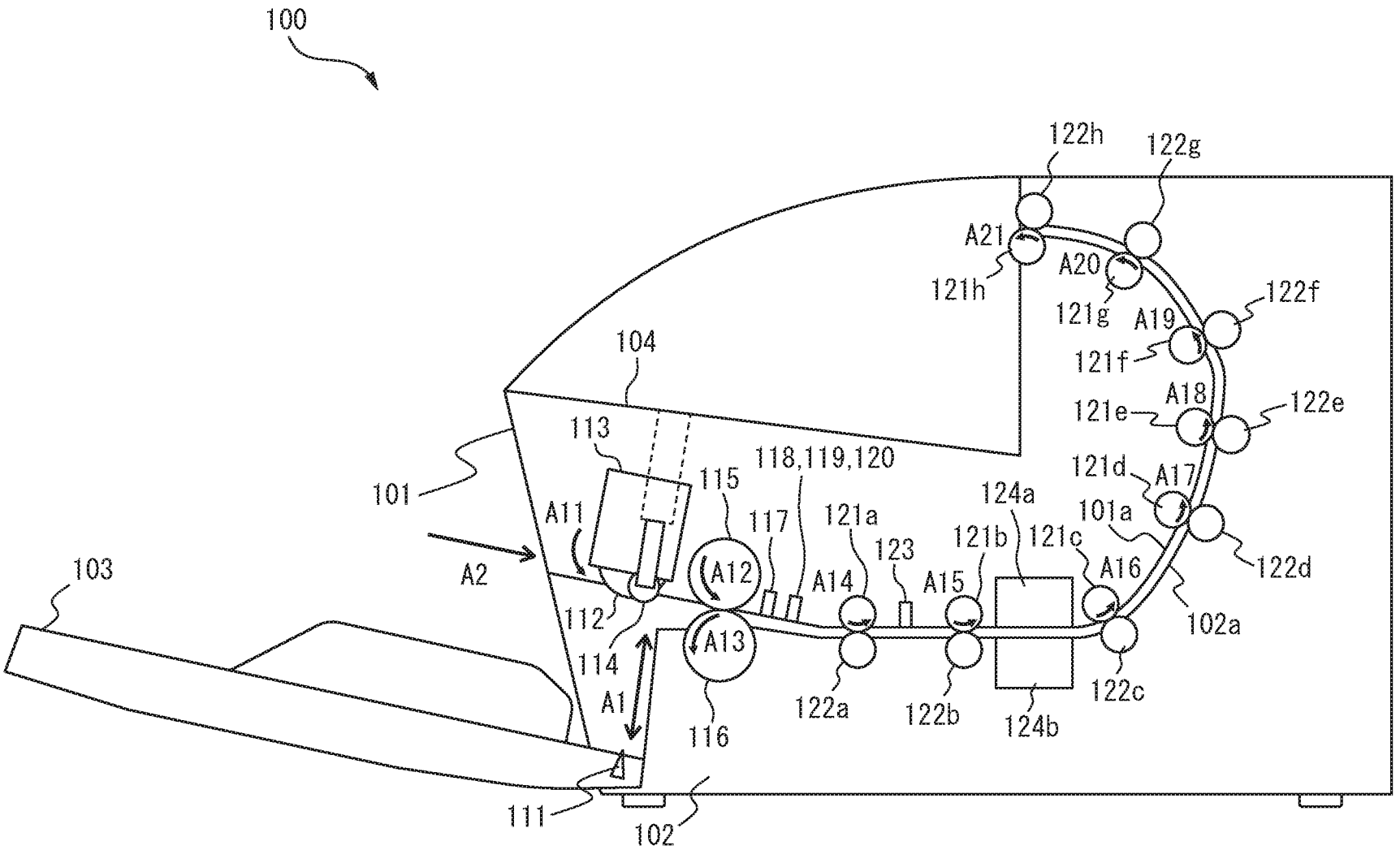
FIG. 2 is a diagram for illustrating a conveyance path inside the medium conveying apparatus 100.

FIG. 2 is a diagram for illustrating a conveyance path inside the medium conveying apparatus 100.

A conveyance path inside the medium conveying apparatus 100 includes a first sensor 111, a pick roller 112, a movement mechanism 113, an encoder 114, a feed roller 115, a brake roller 116, a second sensor 117, a third sensor 118, a fourth sensor 119, a fifth sensor 120, a first to eighth conveying rollers 121*a* to 121*h*, a first to eighth driven rollers 122*a* to 122*h*, a sixth sensor 123, a first imaging device 124*a* and a second imaging device 124*b*, etc.

The number of each of the pick roller 112, the feed roller 115, the brake roller 116, the first to eighth conveying rollers 121*a* to 121*h*, and/or the first to eighth driven rollers 122*a* to 122*h* is not limited to one, and may be plural. In that case, a plurality of feed rollers 115, brake rollers 116, first to eighth conveying rollers 121*a* to 121*h*, and/or first to eighth driven rollers 122*a* to 122*h* are located apart from each other along in the width direction A3 perpendicular to the medium conveying direction, respectively.

The surface of the first housing 101 facing the second housing 102 forms a first guide 101*a* of the medium conveyance path, and the surface of the second housing 102 facing the first housing 101 forms a second guide 102*a* of the medium conveyance path.

The first sensor 111 is located on the medium tray 103, i.e., on the upstream side of the feed roller 115 and the brake roller 116, to detect a mounting state of the medium in the medium tray 103. The first sensor 111 determines whether or not the medium is placed on the medium tray 103, by a contact detection sensor to pass a predetermined current when a medium is in contact or a medium is not in contact. The first sensor 111 generates and outputs a first medium signal whose signal value changes between a state in which a medium is placed on the medium tray 103 and a state in which a medium is not placed. The first sensor 111 is not limited to the contact detection sensor, any other sensor, such as a light detection sensor, capable of detecting the presence or absence of the medium may be used as the first sensor 111.

The pick roller 112 is an example of a first roller. The pick roller 112 is provided in the first housing 101, and comes into contact with the medium placed on the medium tray 103 lifted to a height substantially equal to that of the medium conveyance path to feed and convey the medium to the downstream side.

The encoder 114 is located in such a way that at least a part of the encoder 114 is overlapped with the pick roller 112 in the medium conveying direction A2, i.e., at least a part of the encoder 114 is overlapped with the pick roller 112 when viewed from the width direction A3, to detect a conveyance of the medium at an arrangement position of the pick roller 112. The encoder 114 includes a disk on which a large number of slits (light transmission holes) are formed, the disk being provided to rotate according to the medium fed by the pick roller 113, and a light emitter and a light receiver provided to face one another with the disk in between. The light emitter is an LED (Light Emitting Diode), etc., and emits light toward the disk (light receiver). The light receiver receives the light emitted by the light emitter through the disk. The light receiver detects the number of times of changes from a state in which a slit exists between the light emitter and the light receiver to a state in which the slit is not present and the light is blocked by the disk, within a predetermined period. The light receiver detects a movement distance of the medium conveyed by the pick roller 112 by multiplying the detected number of times of changes by a distance by which an outer peripheral surface of the encoder 114 moves when the disk rotates by a distance between two slits adjacent to each other. The encoder 114 generates and outputs a distance signal indicating the detected movement distance.

The feed roller 115 is an example of a second roller. The feed roller 115 is located in the first housing 101, and on the downstream side of the pick roller 112 in the medium conveying direction A2, to feed and convey the medium placed on the medium tray 103 and fed and conveyed by the pick roller 112 further toward the downstream side. The brake roller 116 is located in the second housing 102, to face the feed roller 115. The feed roller 115 and the brake roller 116 perform a medium separation operation to separate the media and feed them one by one.

The first to eighth conveying rollers 121*a* to 121*h* and the first to eighth driven rollers 122*a* to 122*h* are provided on the downstream side of the feed roller 115 and the brake roller 116, to convey the medium fed by the feed roller 115 and the brake roller 116 toward the downstream side.

The first imaging device 124*a* and the second imaging device 124*b* are examples of an Imaging device, and are located on the downstream side of the first to second conveying rollers 121*a* to 121*b*, i.e., on the downstream side of the second to sixth sensors 117, 118, 119, 120 and 123, in the medium conveying direction A2.

The first imaging device 124*a* includes a line sensor based on a unity-magnification optical system type contact image sensor (CIS) including an imaging element based on a complementary metal oxide semiconductor (CMOS) linearly located in a main scanning direction. Further, the first imaging device 124*a* includes a lens for forming an image on the imaging element, and an A/D converter for amplifying and analog-digital (A/D) converting an electric signal output from the imaging element. The first imaging device 124*a* generates and outputs an input image by imaging a front side of the conveyed medium.

Similarly, the second imaging device 124*b* includes a line sensor based on a unity-magnification optical system type CIS including an imaging element based on a CMOS linearly located in a main scanning direction. Further, the second imaging device 124*b* includes a lens for forming an image on the image element, and an A/D converter for amplifying and analog-digital (A/D) converting an electric signal output from the imaging element. The second imaging device 124*b* generates and outputs an input image by imaging a back side of the conveyed medium.

Only either of the first imaging device 124*a* and the second imaging device 124*b* may be located in the medium conveying apparatus 100 and only one side of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs may be used. Hereinafter, the first imaging device 124*a* and the second imaging device 124*b* may be collectively referred to as imaging devices 124.

A medium placed on the medium tray 103 is conveyed in the medium conveying direction A2 between the first guide 101*a* and the second guide 102*a* by the pick roller 112 rotating in a medium feeding direction A11 and the feed roller 115 rotating in a medium feeding direction A12. On the other hand, when a plurality of media are placed on the medium tray 103, only a medium in contact with the feed roller 115, out of the media placed on the medium tray 103 is separated, by the brake roller 116 rotating in a direction A13 opposite to the medium feeding direction.

The medium is fed to an imaging position of the imaging device 124 while being guided by the first guide 101*a* and the second guide 102*a*, by the first to second conveyance rollers 121*a* to 121*b* rotating in directions of arrows A14 to A15, respectively, and is imaged by the imaging device 124. The medium is ejected on the ejection tray 104 by the third to eighth conveyance rollers 121*c* to 121*h* rotating in directions of arrows A16 to A21, respectively.

Figure 3A:
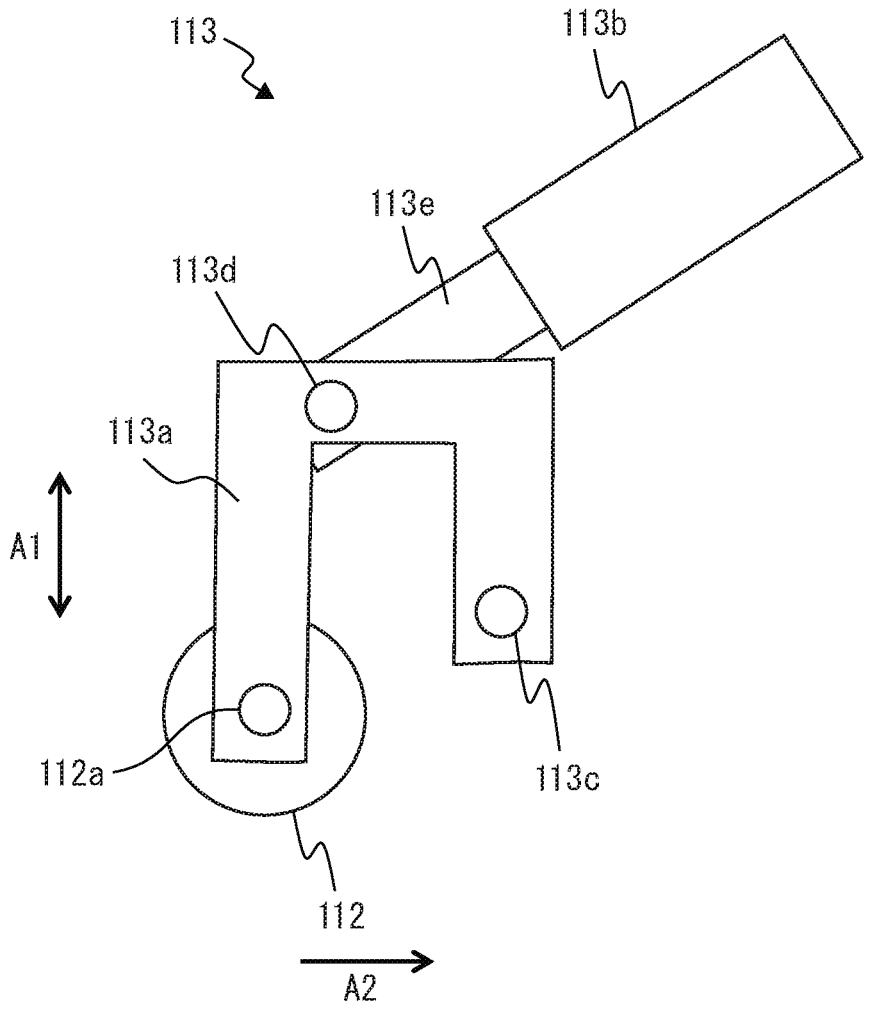
FIG. 3A is a schematic view for illustrating a movement mechanism 113.
Figure 3B:
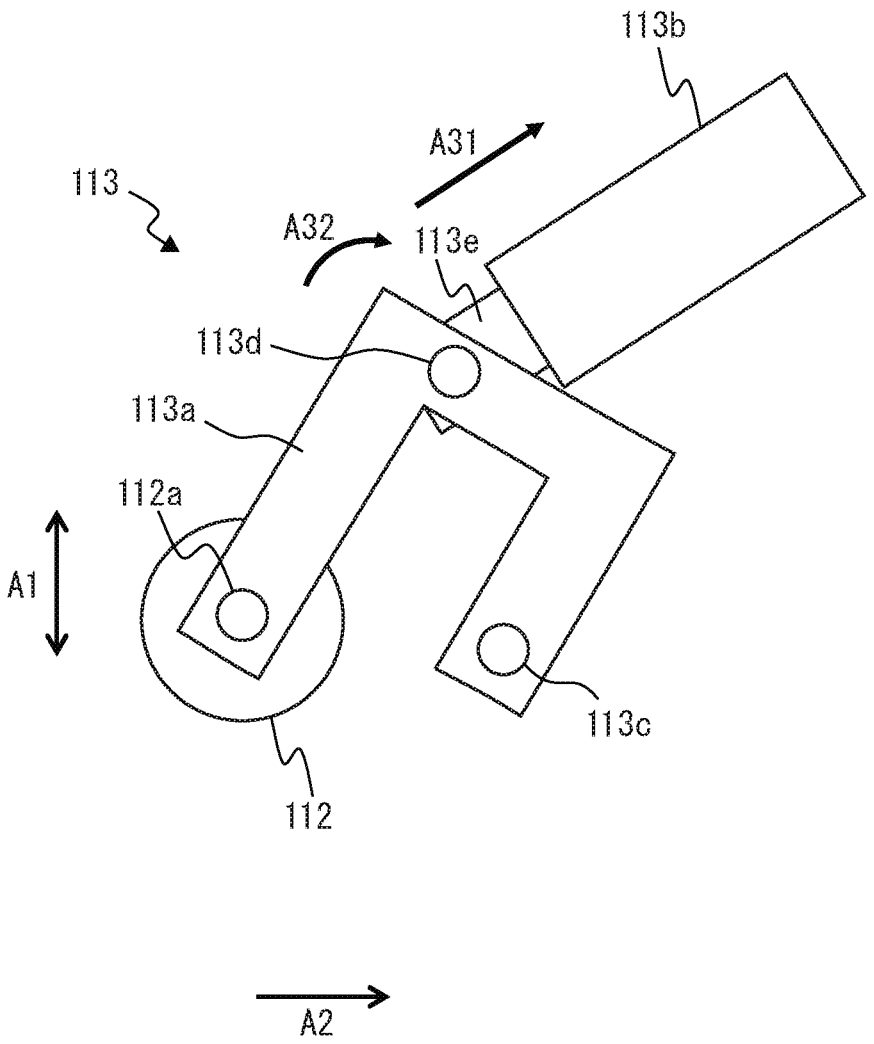
FIG. 3B is a schematic view for illustrating the movement mechanism 113.

FIGS. 3A and 3B are schematic views for illustrating the movement mechanism 113. FIGS. 3A and 3B are schematic views of the pick roller 112 and the movement mechanism 113, as viewed from the side of the medium conveying apparatus 100.

As illustrated in the FIGS. 3A and 3B, the movement mechanisms 113 include a cam member 113*a* and a solenoid 113*b*, etc.

The cam member 113*a* has a U-shape, and supports the pick roller 112. One end 113*c* of the cam member 113*a* is rotatably supported by the first housing 101, and a shaft 112*a* being a rotation shaft of the pick roller 112, is attached to the other end of the cam member 113*a*. The front end of the movable magnetic pole 113*e* of the solenoid 113*b* is attached to the central portion 113*d* of the cam member 113*a*.

The solenoid 113*b* is located inside the first housing 101 so as to be inclined with respect to the cam member 113*a*. The solenoid 113*b* slides the movable magnetic pole 113*e* in accordance with a control signal from a processing circuit to be described later.

As shown in FIG. 3A, in an initial state, the movable magnetic pole 113*e* is pushed out, and the pick roller 112 attached to the cam member 113*a* is located at a first position in contact with the medium placed on the medium tray 103. On the other hand, as shown in the FIG. 3B, when the movable magnetic pole 113*e* is pulled in a direction of an arrow A31, the cam member 113*a* rotates about the one end 113*c* in a direction of an arrow A32 according to the sliding motion of the movable magnetic pole 113*e*. The pick roller 112 moves upward in the height direction A1 according to the rotation of the cam member 113*a*, and is located at a second position spaced apart from the medium placed on the medium tray 103. Thus, the movement mechanism 113 moves the pick roller 112 between the first position in contact with the conveyed medium and the second position spaced apart from the conveyed medium.

Figure 4:
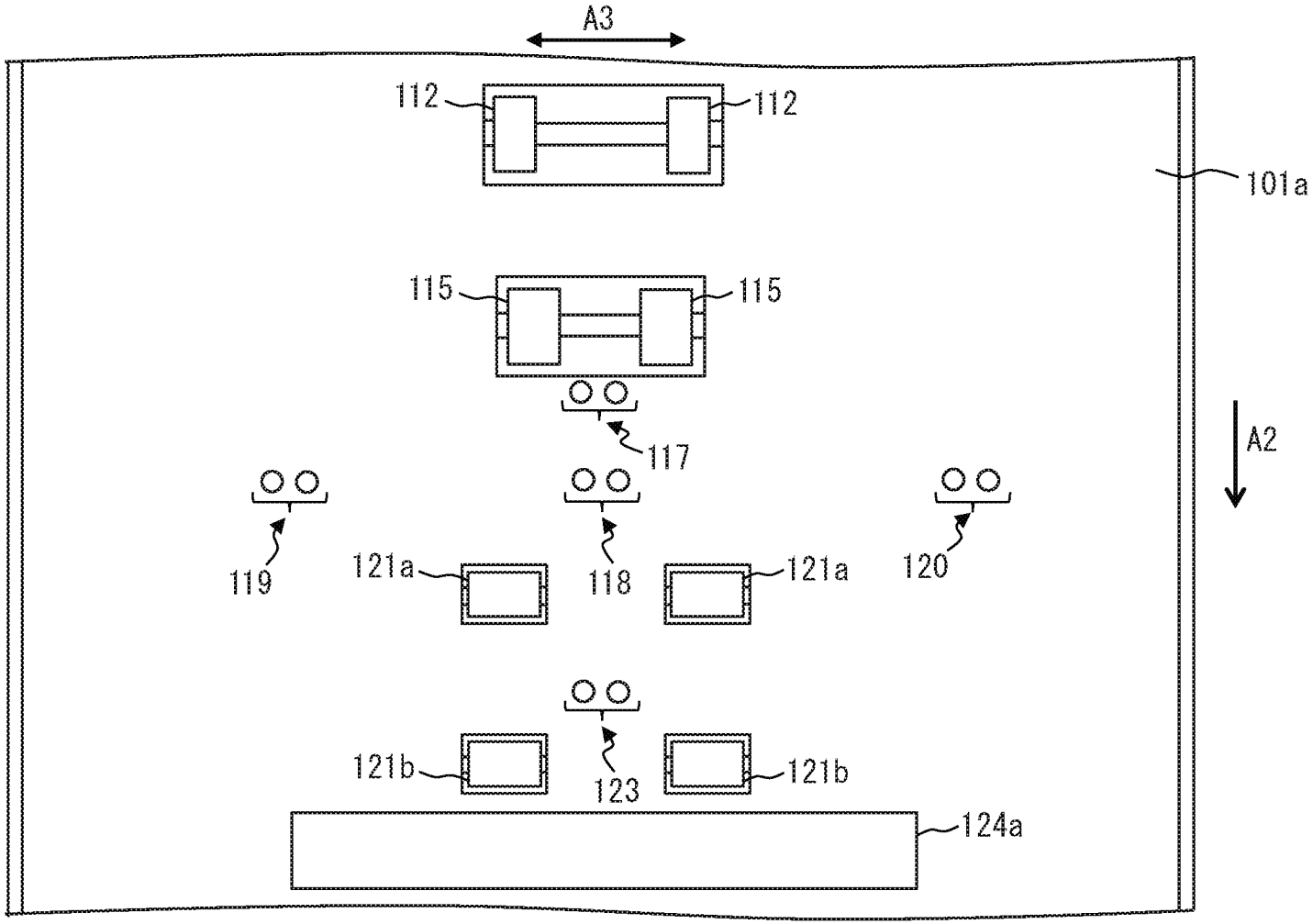
FIG. 4 is a schematic view for illustrating arrangement positions of each roller and each sensor.

FIG. 4 is a schematic view for illustrating the arrangement positions of each roller and each sensor. FIG. 4 is a schematic view of a part of the first housing 101 in an open state, as viewed from the conveyance path side.

In an example shown in FIG. 4, The number of the pick roller 112, the feed roller 115 and the first to eighth conveying rollers 121*a* to 121*h* included in the medium conveying apparatus 100 is two, respectively.

A plurality of feed rollers 115 are located apart from each other along in the width direction A3 perpendicular to the medium conveying direction. The feed rollers 115 are provided in such a way as to independently rotate, and feed the medium by separate motors, respectively. The feed rollers 115 may be provided in such a way as to rotate by a common motor.

The second sensor 117 is an example of a second medium sensor. The second sensor 117 is located on the downstream side of the feed roller 115 and the brake roller 116 and on the upstream side of the first conveying roller 121*a* and the first driven roller 122*a*, particularly on the upstream side of the third to fifth sensors 118 to 120, in the medium conveying direction A2. The second sensor 117 is located at a central portion, particularly between the feed rollers 115, in the width direction A3 perpendicular to the medium conveying direction. The second sensor 117 includes a light emitter and a light receiver provided on one side with respect to the conveyance path of the medium, and a reflection member such as a mirror provided at a position facing the light emitter and the light receiver with the conveyance path in between. The light emitter is an LED, etc., and emits light toward the medium conveyance path. On the other hand, the light receiver receives light projected by the light emitter and reflected by the reflection member, and generates and outputs a second medium signal being an electric signal based on intensity of the received light.

The light emitted by the light emitter is shielded by the medium when the medium is present at the position of the second sensor 117. Therefore, the signal value of the second medium signal is changed in a state where the medium is present at the position of the second sensor 117 and a state where the medium is not present. Consequently, the second sensor 117 detects whether or not a medium exists at the position and detects a fed medium. The light emitter and the light receiver of the second sensor 117 may be provided at positions facing one another with the conveyance path in between, and the reflection member may be omitted. The second sensor 117 may detect the presence of the medium by a contact detection sensor, etc., to pass a predetermined current when a medium is in contact or a medium is not in contact.

The third to fifth sensors 118 to 120 are examples of a plurality of medium sensors. The third to fifth sensors 118 to 120 are located on the downstream side of the feed roller 115 and the brake roller 116, particularly on the downstream side of the second sensor 117, and on the upstream side of the first conveying roller 121*a* and the first driven roller 122*a*, in the medium conveying direction A2. The third to fifth sensors 118 to 120 are located apart from each other along in the width direction A3 perpendicular to the medium conveying direction. The third sensor 118 is located in the central portion, in particular between the feed rollers 115, in the width direction A3. The fourth and fifth sensors 119 and 120 are located outside the third sensor 118, particularly outside the feed rollers 115. The fourth and fifth sensors 119 and 120 are located on opposite sides to each other with respect to the third sensor 118.

The third to fifth sensors 118 to 120 have the same configuration as the second sensor 117, respectively. The third sensor 118 generates and outputs a third medium signal being an electrical signal corresponding to intensity of the received light emitted by the light emitter and reflected by the reflecting member. The fourth sensor 119 generates and outputs a fourth medium signal being an electrical signal corresponding to intensity of the received light emitted by the light emitter and reflected by the reflecting member. The fifth sensor 120 generates and outputs a fifth medium signal being an electrical signal corresponding to intensity of the received light emitted by the light emitter and reflected by the reflecting member.

The sixth sensor 123 is an example of a third medium sensor. The sixth sensor 123 is located on the downstream side of the first conveying roller 121*a* and the first driven roller 122*a* and on the upstream side of the second conveying roller 121*b* and the second driven roller 122*b*, i.e., between the third to fifth sensors 118 to 120 and the imaging device 124, in the medium conveying direction A2. The third sensor 118 is located in the central portion in the width direction A3, particularly between the first conveying rollers 121*a*.

The sixth sensor 123 has the same configuration as the second sensor 117. The sixth sensor 123 generates and outputs a sixth medium signal being an electrical signal corresponding to intensity of the received light emitted by the light emitter and reflected by the reflecting member.

Figure 5:
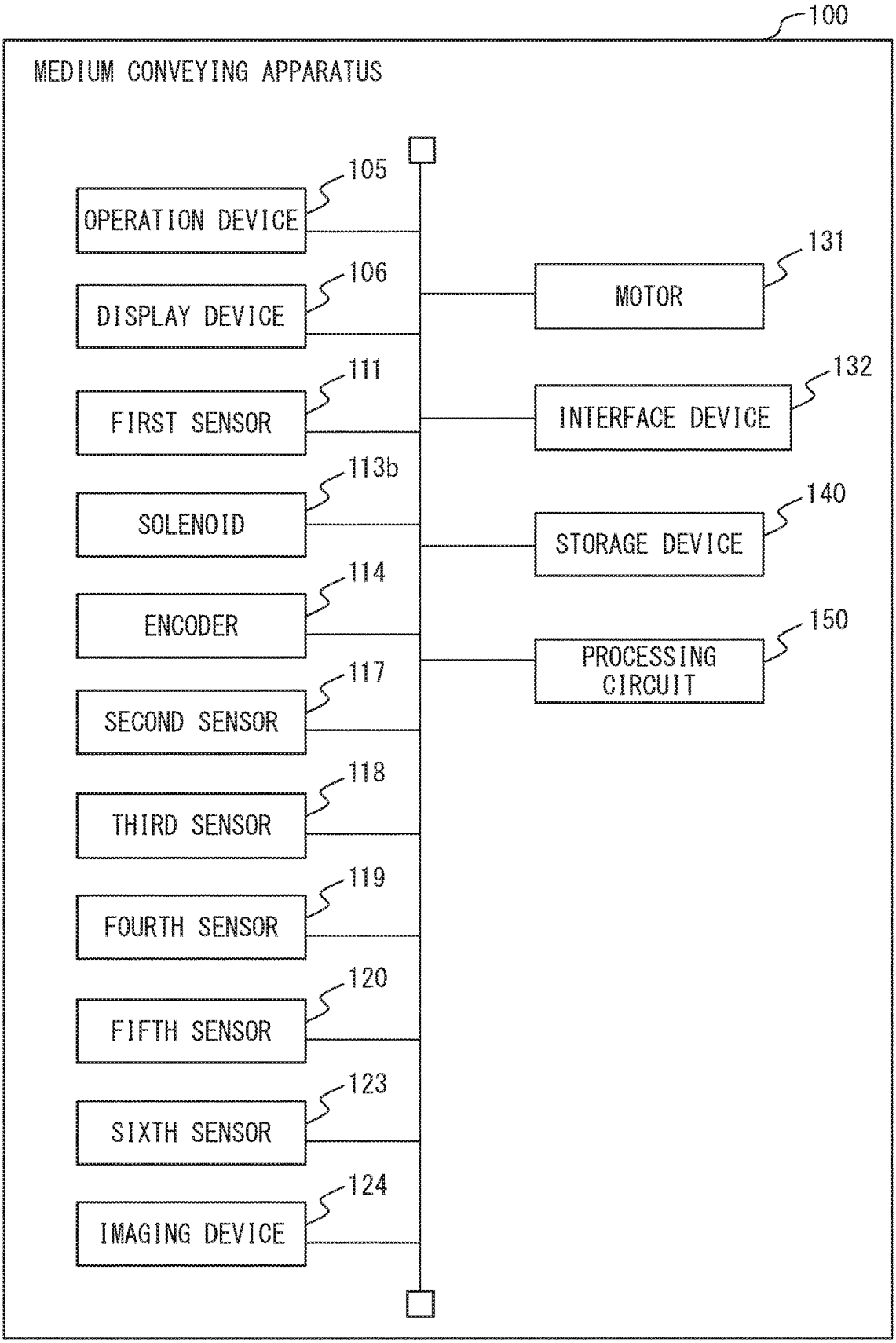
FIG. 5 is a block diagram illustrating a schematic configuration of the medium conveying apparatus 100.

FIG. 5 is a block diagram illustrating a schematic configuration of a medium conveying apparatus 100.

The medium conveying apparatus 100 further includes a motor 131, an interface device 132, a storage device 140, and a processing circuit 150, etc., in addition to the configuration described above.

The motor 131 includes one or more motors, and rotatably drives the pick roller 112, the feed roller 115, the brake roller 116, and the first to eighth conveying rollers 121*a* to 121*h* by a control signal from the processing circuit 150 to feed and convey the medium. In particular, the motor 131 has separate motors to rotate the feed rollers 115 independently, respectively. The first to eighth driven rollers 122*a* to 122*h* may be provided to rotate by the driving force from the motor 131 rather than to be driven to rotate according to the rotation of the first to eighth conveying rollers 121*a* to 121*h*.

The interface device 132 includes, for example, an interface circuit conforming to a serial bus such as universal serial bus (USB), is electrically connected to an unillustrated information processing device (for example, a personal computer or a mobile information terminal), and transmits and receives an input image and various types of information. Further, a communication device including an antenna transmitting and receiving wireless signals, and a wireless communication interface circuit for transmitting and receiving signals through a wireless communication line in conformance with a predetermined communication protocol may be used in place of the interface device 132. For example, the predetermined communication protocol is a wireless local area network (LAN).

The storage device 140 is an example of a storage module. The storage device 140 includes a memory device such as a random access memory (RAM) or a read only memory (ROM), a fixed disk device such as a hard disk, or a portable storage device such as a flexible disk or an optical disk. Further, the storage device 140 stores a computer program, a database, a table, etc., used for various types of processing in the medium conveying apparatus 100. The computer program may be installed on the storage device 140 from a computer-readable, non-transitory medium such as a compact disc read only memory (CD-ROM), a digital versatile disc read only memory (DVD-ROM), etc., by using a well-known setup program, etc.

The processing circuit 150 operates in accordance with a program previously stored in the storage device 140. The processing circuit 150 is, for example, a CPU (Central Processing Unit). The processing circuit 150 may be a digital signal processor (DSP), a large scale integration (LSI), an application specific integrated circuit (ASIC), a field-programmable gate array (FPGA), etc.

The processing circuit 150 is connected to the operation device 105, the display device 106, the first sensor 111, the solenoid 113*b*, the encoder 114, the second sensor 117, the third sensor 118, the fourth sensor 119, the fifth sensor 120, the sixth sensor 123, the imaging device 124, the motor 131, the interface device 132 and the storage device 140, etc., to control these respective units. The processing circuit 150 controls the motor 131 to feed and convey the medium, and controls the imaging device 124 to acquire an input image, and transmits the acquired input image to the information processing apparatus via the interface device 132. The processing circuit 150 detects a skew of the medium based on each medium signal output from each sensor, controls the solenoid 113*b* to move the pick roller 112, and controls the motor 131 to correct the skew of the medium.

Figure 6:
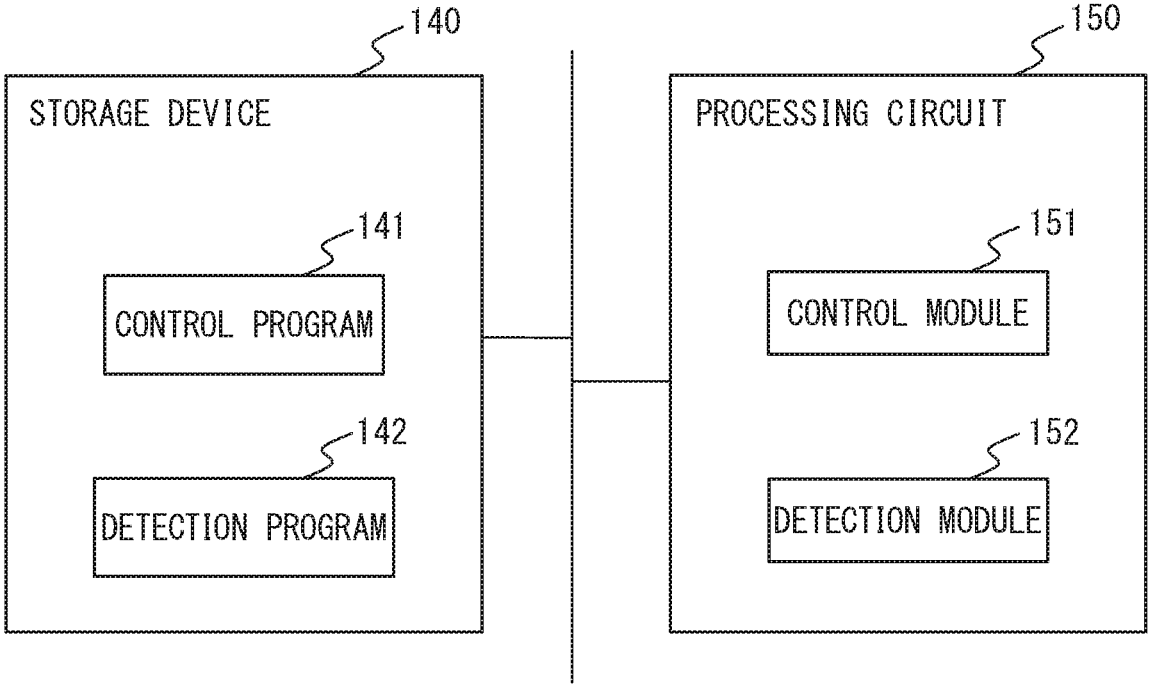
FIG. 6 is a diagram illustrating schematic configurations of a storage device 140 and a processing circuit 150.

FIG. 6 is a diagram illustrating schematic configurations of the storage device 140 and the processing circuit 150.

As shown in FIG. 6, each program such as a control program 141 and a detection program 142, etc., is stored in the storage device 140. Each of these programs is a functional module implemented by software operating on a processor. The processing circuit 150 reads each program stored in the storage device 140 and operates in accordance with each read program, to function as a control module 151 and the detection module 152.

Figure 7:
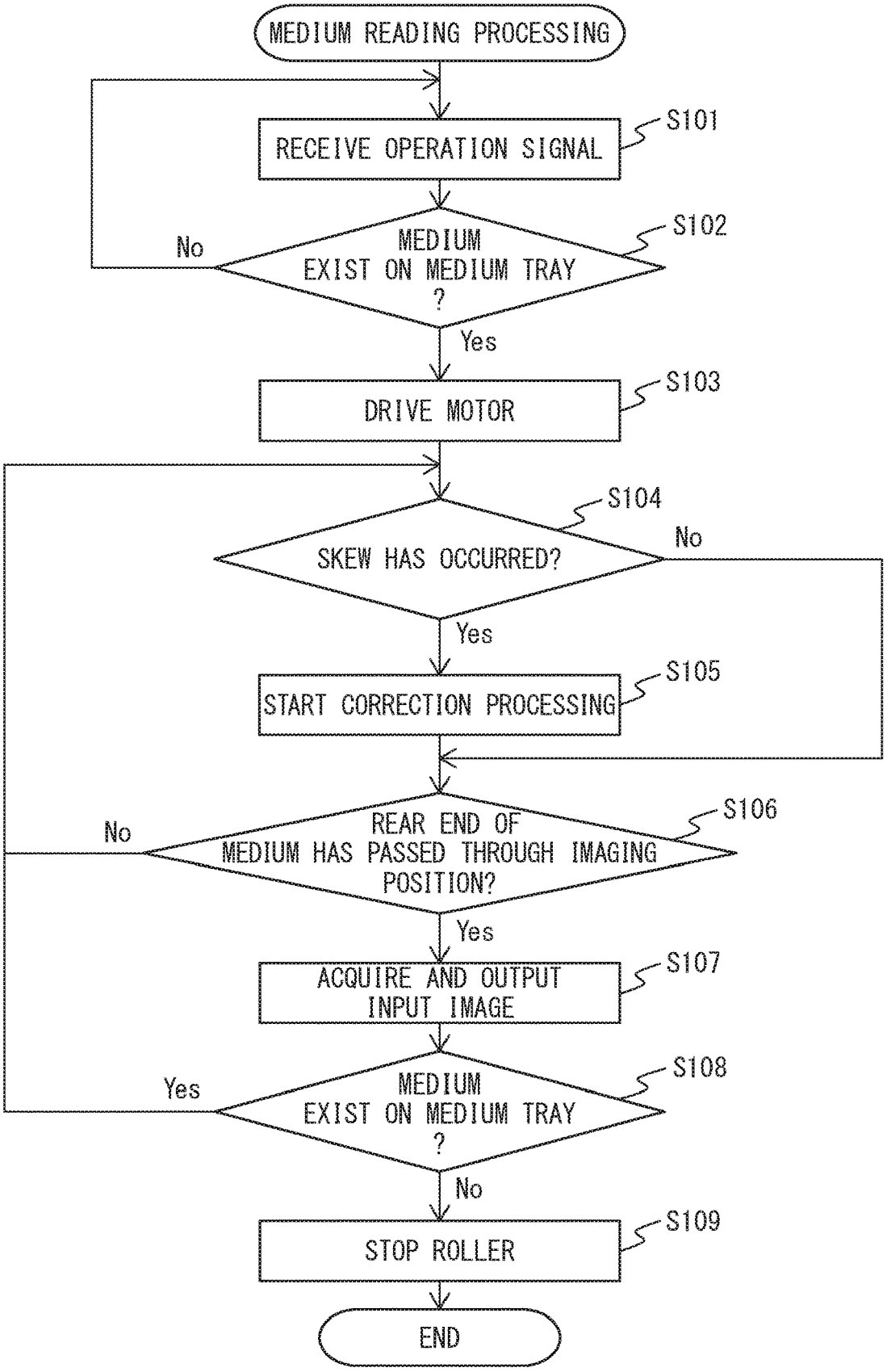
FIG. 7 is a flowchart illustrating an operation example of the medium reading processing.

FIG. 7 is a flowchart illustrating an operation example of the medium reading processing.

Hereinafter, the operation example of the medium reading processing in the medium conveying apparatus 100 will be described with referring to the flowchart shown in FIG. 7. The operation flow described below is executed mainly by the processing circuit 150 in cooperation with each element in the medium conveying apparatus 100, in accordance with a program previously stored in the storage device 140. Before the flow shown in FIG. 7 is performed, the pick roller 112 is located in the first position in contact with the medium placed on the medium tray 103.

First, the control module 151 stands by until an instruction to read a medium is input by the user by use of the operation device 105 or the information processing device, and an operation signal instructing to read the medium is received from the operation device 105 or the interface device 132 (step S101).

Next, the control module 151 acquires the first medium signal from the first sensor 111 and determines whether or not a medium is placed on the medium tray 103 based on the acquired first medium signal (step S102). When a medium is not placed on the medium tray 103, the control module 151 returns the processing to step S101 and stands by until newly receiving an operation signal from the operation device 105 or the interface device 132.

On the other hand, when the medium is placed on the medium tray 103, the control module 151 drives the motor 131 and rotates the pick roller 112, the feed roller 115, the brake roller 116, and the first to eighth conveying rollers 121*a* to 121*h* (step S103). Thus, the control module 151 feeds and conveys the medium placed on the medium tray 103. At this time, the control module 151 rotates the feed rollers 115 so that the respective circumferential speeds of the feed rollers 115 are the same reference speed.

Next, the detection module 152 determines whether or not the skew of the conveyed medium has occurred (step S104). The detection module 152 periodically acquires a second medium signal from the second sensor 117, a third medium signal from the third sensor 118, a fourth medium signal from the fourth sensor 119, and a fifth medium signal from the fifth sensor 120, respectively. The detection module 152 determines whether or not the skew of the conveyed medium has occurred based on the acquired second medium signal, the third medium signal, the fourth medium signal and the fifth medium signal.

The detection module 152 determines that the front end of the medium has passed through a position of each sensor that generated each medium signal when a signal value of each medium signal changes from a value indicating that there is no medium to a value indicating that a medium exists. For example, the detection module 152 determines that the skew of the medium has occurred when the front end of the medium passes through the position of the fourth sensor 119 or the fifth sensor 120, before the front end of the medium passes through the position of the second sensor 117. Further, the detection module 152 determines that the skew of the medium has occurred when the front end of the medium does not pass through the position of the third sensor 118 in a first predetermined time after the front end of the medium passes through the position of the fourth sensor 119 or the fifth sensor 120, after the front end of the medium passes through the position of the second sensor 117. The first predetermined time, for example, is set to the minimum value of a difference between the time when the front end of the medium conveyed with an inclination that causes a jam of the medium passes through the position of the fourth sensor 119 or the fifth sensor 120, and the time when it passes through the position of the third sensor 118.

Figure 8:
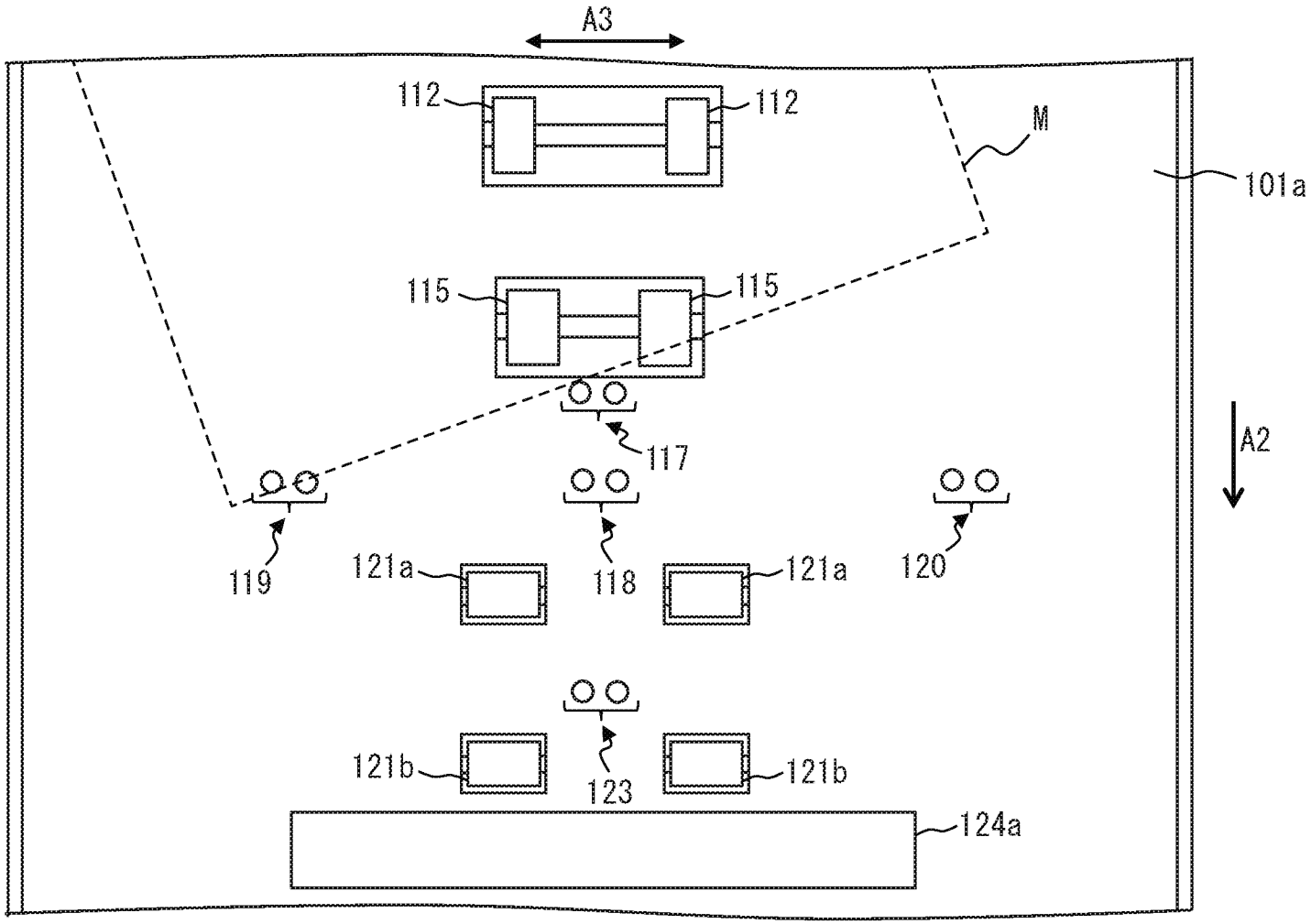
FIG. 8 is a schematic view for illustrating a skew of a medium.

FIG. 8 is a schematic view for illustrating the skew of the medium.

As shown in FIG. 8, when the front end of the conveyed medium M passes through the position of the fourth sensor 119 or the fifth sensor 120 located on the downstream side of the second sensor 117 and outside of the second sensor 117 before it passes through the position of the second sensor 117, the medium M is likely to be inclined. Further, even when the front end of the medium M passes through the position of the fourth sensor 119 or the fifth sensor 120 located downstream of the second sensor 117, after the front end of the medium M passes through the position of the second sensor 117, the medium M may be inclined. For example, when the time from when the front end of the medium M passes through the position of the fourth sensor 119 or the fifth sensor 120 located on the outside to when it passes through the position of the third sensor 118 located in the central portion is large, the medium M is likely to be inclined.

Therefore, the detection module 152 determines whether or not the medium is conveyed with an inclination, to detect the skew of the fed and conveyed medium, based on the output signals from the second sensor 117, the third sensor 118, the fourth sensor 119 and the fifth sensor 120.

Incidentally, the detection module 152 may determine whether or not the skew of the medium has occurred, based on the image generated by the imaging device 124. In that case, the detection module 152 acquires a medium image including at least the front end of the conveyed medium from the imaging device 124. The detection module 152 calculates an absolute value (hereinafter, referred to as an adjacent difference value) of the difference between the gradation values of both adjacent pixels in the vertical direction of each pixel in each vertical line, in order from the upper side, for each vertical line extending in the vertical direction (the sub-scanning direction) in the acquired medium image. The detection module 152 detects a pixel whose adjacent difference value exceeds a gradation threshold value in each vertical line as an edge pixel, and detects an edge pixel initially detected in each vertical line, i.e., an edge pixel located at the uppermost side as an upper edge pixel. The gradation value is a luminance value or a color value (R value, G value or B value). For example, the gradation threshold value may be set to a difference in brightness value (for example, 20) according to which a person may determine a difference in brightness on an image by visual observation.

The detection module 152 may calculate the absolute value of the difference between the gradation values of the two pixels separated each other by a predetermined distance in the vertical direction in the medium image as the adjacent difference value. Further, the detection module 152 may detect the edge pixel by comparing the gradation value of each pixel in the medium image with the threshold value. For example, the detection module 152 detects a specific pixel as the edge pixel when the gradation value of the specific pixel is less than the threshold value and the gradation value of the pixel adjacent to the specific pixel in the vertical direction or the pixel separated by a predetermined distance in the vertical direction is equal to or more than the threshold value.

Next, the detection module 152 detects a straight line passing through each upper edge pixel using the least squares method or the Huff transform. The detection module 152 calculates an inclination angle of the detected straight line with respect to the horizontal direction (the main scanning direction), and determines that the skew of the medium has occurred when the absolute value of the calculated inclination angle is equal to or more than the angle threshold value.

The control module 151 proceeds the process to step S106 when the detection module 152 determines that the skew of the medium has not yet occurred, i.e., when the skew of the medium is not detected.

On the other hand, the control module 151 starts a correction processing (step S105) when the detection module 152 determines that the skew of the medium has occurred, i.e., when the skew of the medium is detected. Thereafter, the correction processing is performed in parallel with the medium reading processing. The control module 151 controls the solenoid 113*b* to move the pick roller 112 to the second position spaced apart from the medium in the correction processing, and corrects the skew of the medium using the feed roller 115. Details of the correction processing will be described later.

Next, the control module 151 determines whether or not the rear end of the medium has passed through the imaging position of the imaging device 124 (step S106). The control module 151 periodically acquires the sixth medium signal from the sixth sensor 123, and determines that the rear end of the medium has passed through the position of the sixth sensor 123 when the signal value of the sixth medium signal changes from a value indicating that the medium is present to a value indicating that there is no medium. The control module 151 determines that the rear end of the medium has passed through the imaging position when a second predetermined time has elapsed after the rear end of the medium passes through the position of the sixth sensor 123. The second predetermined time is set to a value acquired by adding a margin to a division value acquired by dividing a distance between the position of the sixth sensor 123 and the imaging position, by a conveyance speed of the medium. When the rear end of the medium has not yet passed through the imaging position, the control module 151 returns the process to step S104, and repeats the processes in steps S104 to S106.

On the other hand, when the rear end of the medium has passed through the imaging position, the control module 151 acquires the input image from the imaging device 124, and outputs the acquired input image by transmitting it to the information processing apparatus via the interface device 132 (step S107).

Next, the control module 151 determines whether or not a medium remains on the medium tray 103, based on the first medium signal received from the first sensor 111 (step S108). When a medium remains on the medium tray 103, the control module 151 returns the process to step S104 and repeats the processes in steps S104 to S108.

On the other hand, when the medium does not remain on the medium tray 103, the control module 151 stops the motor 131 to stop the rotation of the respective rollers (step S109), and ends the series of steps.

Figure 9:
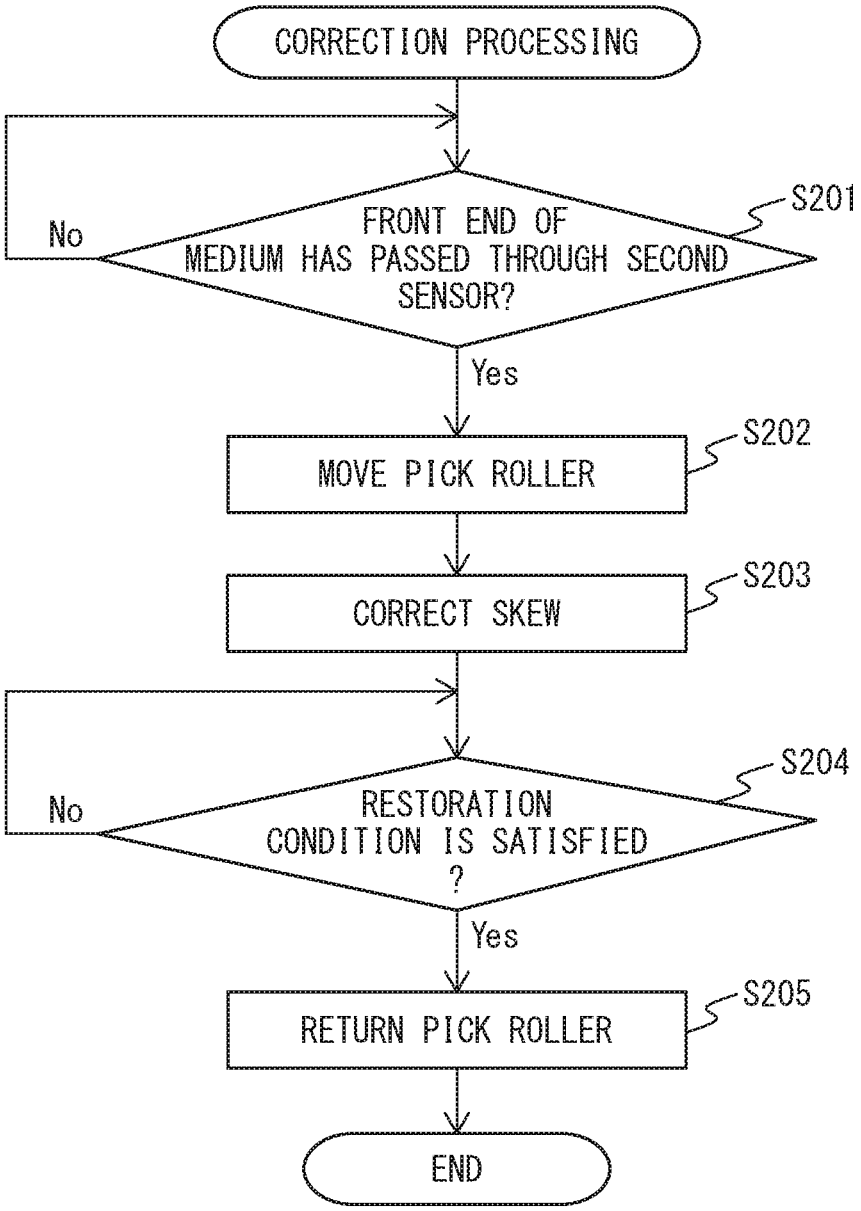
FIG. 9 is a flowchart illustrating an operation example of the correction processing.

FIG. 9 is a flowchart illustrating an operation example of the correction processing of the medium conveying apparatus 100.

Hereinafter, the operation example of the correction processing in the medium conveying apparatus 100 will be described with referring to the flowchart shown in FIG. 9. The operation flow described below is executed mainly by the processing circuit 150 in cooperation with each element in the medium conveying apparatus 100, in accordance with a program previously stored in the storage device 140. The flow of the operation shown in FIG. 9 starts in step S105 of the medium reading processing shown in FIG. 7.

First, the control module 151 waits until the front end of the medium passes through the position of the second sensor 117 (step S201). The control module 151 proceeds the process to step S202 when the detection module 152 determines that the front end of the medium has already passed through the position of the second sensor 117 in step S104. On the other hand, the control module 151 determines whether or not the front end of the medium has passed through the position of the second sensor 117, in the same manner as the process of step S104, when the detection module 152 has not yet determined that the front end of the medium has passed through the position of the second sensor 117 in step S104.

When the front end of the medium passes through the position of the second sensor 117, the control module 151 controls the solenoid 113*b* to move the pick roller 112 to the second position spaced apart from the medium placed on the medium tray 103 (step S202). Thus, the control module 151 controls the solenoid 113*b* so as to move the pick roller 112 to the second position when the front end of the fed and conveyed medium passes through the position of the second sensor 117.

Figure 10:
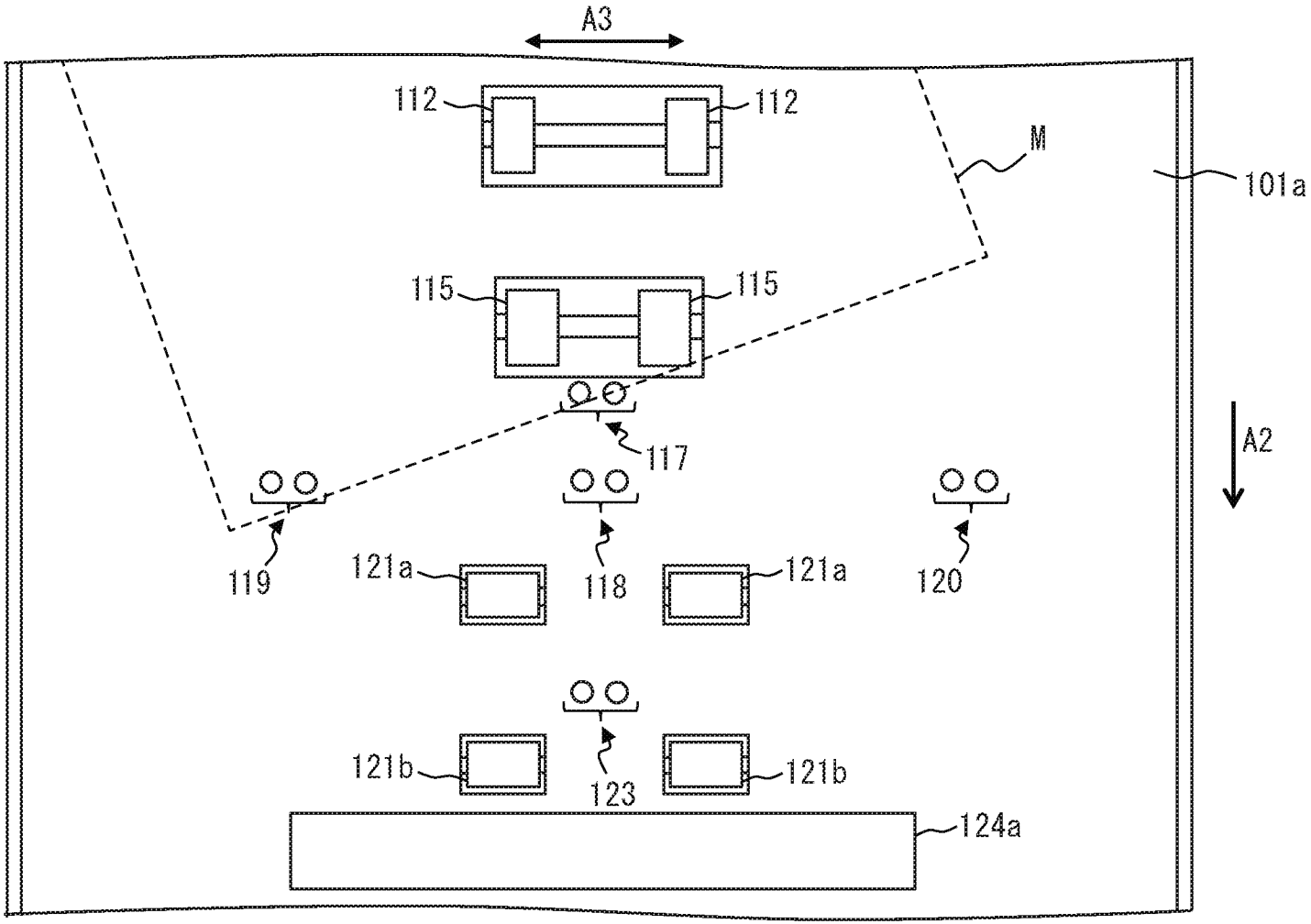
FIG. 10 is a schematic view for illustrating movement timing.

FIG. 10 is a schematic view for illustrating the movement timing of the pick roller 112. FIG. 10 shows a state in which the medium M shown in FIG. 8 is further conveyed to the downstream side.

As shown in FIG. 10, the second sensor 117 is located on the downstream side of the feed rollers 115 in the medium conveying direction A2 and between the feed rollers 115 in the width direction A3. Therefore, even when the medium M is conveyed with an inclination, the front end of the medium M is likely to have passed through a nip position of the feed roller 115 and the brake roller 116 when the front end of the medium M has passed through the position of the second sensor 117. In particular, even when the medium M is conveyed in a state being placed in the central portion of the medium tray 103 in the width direction A3, or even when the medium M is conveyed in a state being placed closer to one end of the medium tray 103, the front end of the medium M is likely to have passed through the nip position when the front end of the medium M has passed through the position of the second sensor 117. Therefore, even when the pick roller 112 moves to the second position and is spaced apart from the medium M, the medium M is likely to be stably fed by the feed roller 115 and the brake roller 116.

Thus, the control module 151 can more reliably feed the medium, by moving the pick roller 112 to the second position when the front end of the medium passes through the position of the second sensor 117.

Incidentally, the process of step S201 may be omitted, and the control module 151 may move the pick roller 112 to the second position, regardless of whether the front end of the medium has passed through the position of the second sensor 117. In other words, the control module 151 may control the solenoid 113*b* to move the pick roller 112 to the second position when the front end of the fed and conveyed medium passes through the position of the fourth sensor 119 or the fifth sensor 120. In other words, the control module 151 may control the solenoid 113*b* to move the pick roller 112 to the second position when the fed and conveyed medium first passes a position of any of a plurality of medium sensors. Thus, the control module 151 can start the correction of the medium earlier, and thereby, reduce the conveyance time of the medium.

Next, the control module 151 corrects the skew of the medium using the feed roller 115 (step S203). The control module 151, for example, corrects the skew of the medium by making the circumferential speeds of the feed rollers 115 vary from each other.

The control module 151 changes a circumferential speed of each feed roller 115 in such a way that a circumferential speed of a feed roller 115 located on the side where progression of the medium is delayed in the width direction A3 is faster (higher) than a circumferential speed of a feed roller 115 located on the preceding side. The control module 151 accelerates (increases) the circumferential speed of the feed roller 115 located on the side where progression of the medium is delayed and/or decelerates (decreases) the circumferential speed of the feed roller 115 located on the preceding side. For example, the control module 151 sets each circumferential speed in such a way that the circumferential speed of the feed roller 115 located on the side where progression of the medium is delayed is faster than the circumferential speed of the feed roller 115 located on the preceding side by a factor greater than or equal to 3 and less than or equal to 10. In the example shown in FIG. 10, each circumferential speed is set so that the circumferential speed of the right feed roller 115 is faster than the circumferential speed of the left feed roller 115.

Thus, since the medium rotates about the feed roller 115 located on the preceding side, the skew of the medium is eliminated. Further, at this time, the pick roller 112 is located at the second position, and is not in contact with the fed medium. Therefore, the medium conveying apparatus 100 can efficiently rotate the medium to efficiently eliminate the skew of the medium. Further, since the medium is not pressed by the pick roller 112 while being rotated by the feed roller 115, the medium conveying apparatus 100 can suppress that the damage of the medium occurs.

Further, the control module 151 returns the circumferential speed of the feed rollers 115 to the reference speed, and ends the skew correction of the medium, after a third predetermined time has elapsed after the skew correction of the medium is started. The third predetermined time may be changed according to the magnitude of the inclination of the medium. For example, the third predetermined time when the front end of the medium passes through the position of the fourth sensor 119 or the fifth sensor 120 before it passes through the position of the second sensor 117, may be set to a value more than the third predetermined time otherwise.

Incidentally, the control module 151 may correct the skew of the medium, by controlling a stopper (not shown). In this case, the stopper is located on the downstream side of the feed roller 115 and on the upstream side of the first conveying roller 121*a* in the medium conveying direction A2. The stopper is movably provided between an opposed position facing the fed medium and the non-opposed position not facing the fed medium according to the driving force from the motor 131. The control module 151 controls the motor to drive the stopper to place the stopper in the opposed position by the third predetermined time, to correct the skew of the medium, when the skew of the medium occurs. Although the fed medium is pushed to the downstream side by the feed roller 115, the front end of the medium is stopped by the stopper and does not proceed to the downstream side of the stopper. Therefore, when the front end of the medium is inclined, the front end of the medium rotates so as to be substantially parallel to the width direction A3 at the arrangement position of the stopper by the force pushed out by the feed roller 115.

Next, the control module 151 waits until the restoration condition for returning the pick roller 112 to the first position in contact with the medium is satisfied (step S204).

For example, the control module 151 determines that the restoration condition is satisfied when the correction of the skew of the medium is completed, i.e., when the third predetermined time elapses after the skew correction of the medium is started. Further, the control module 151 may determine that the restoration condition is satisfied when the front end of the medium passes through the position of the third sensor 118 located in the central portion of the width direction A3.

Further, the control module 151 may determine that the restoration condition is satisfied when the front end of the conveyed medium passes through the position of the sixth sensor 123 located on the downstream side of the third to fifth sensors 118 to 120. In that case, the control module 151 periodically acquires the sixth medium signal from the sixth sensor 123, and determines that the front end of the medium has passed through the position of the sixth sensor 123 when the signal value of the sixth medium signal changes from a value indicating that there is no medium to a value indicating that a medium is present.

Further, the control module 151 may determine that the restoration condition is satisfied when the conveyance of the medium at the arrangement position of the pick roller 112 stops. In that case, the control module 151 periodically acquires the distance signal from the encoder 114, and determines that the conveyance of the medium at the arrangement position of the pick roller 112 stops when the movement distance indicated in the distance signal becomes 0. That is, in this case, the rear end of the currently conveyed medium has passed through the arrangement position of the pick roller 112, a medium to be fed next or a placing surface of placing table 103 is opposed to the pick roller 112.

Next, when the restoration condition is satisfied, the control module 151 controls the solenoid 113*b* to return the pick roller 112 to the first position (step S205), and ends the series of steps.

Figure 11:
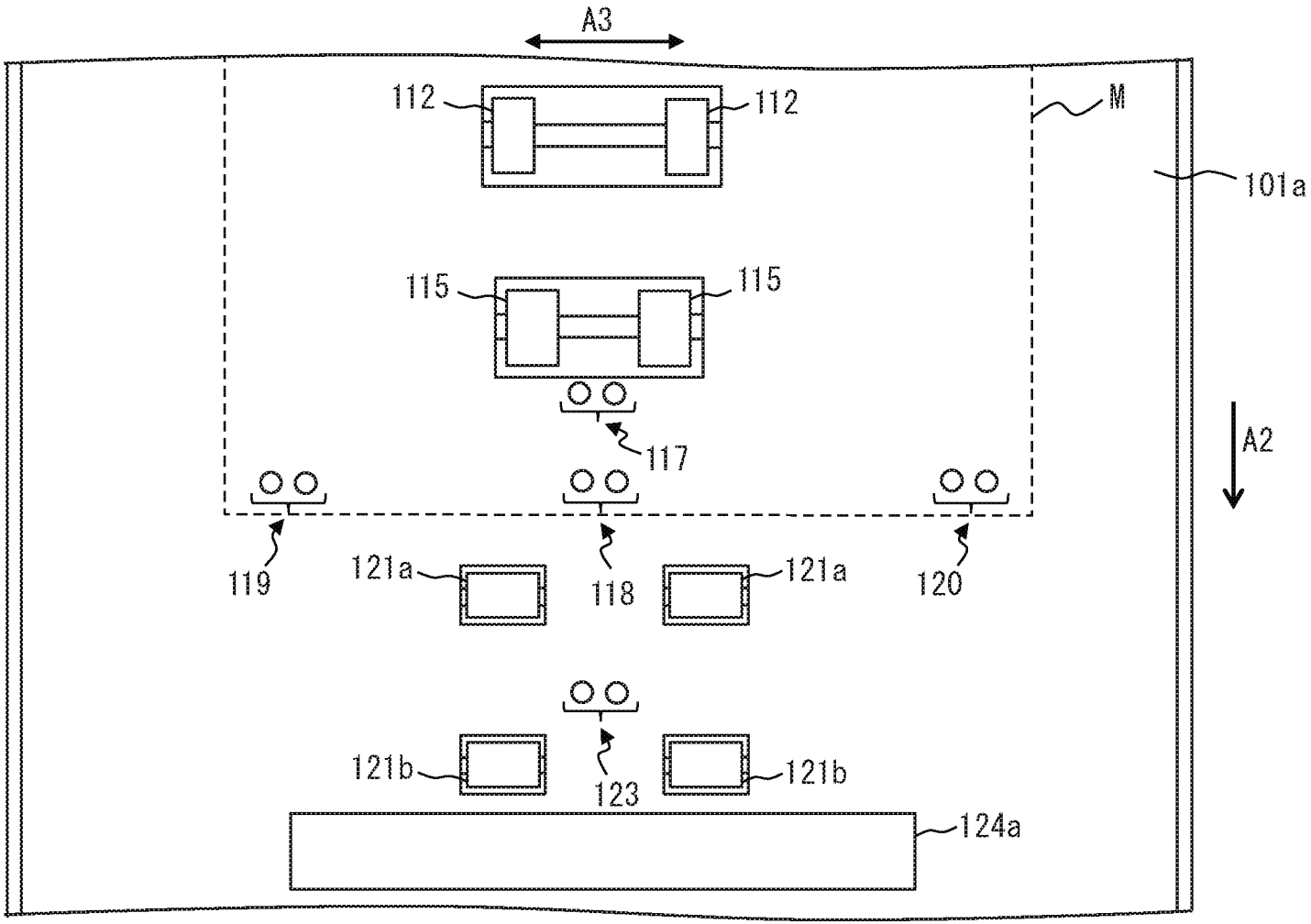
FIG. 11 is a schematic view illustrating a state in which a correction of the skew of the medium is completed.

FIG. 11 is a schematic view illustrating a state in which the correction of the skew of the medium M shown illustrated in FIG. 8.

For example, the control module 151 returns the pick roller 112 to the first position when the correction of the skew of the medium M is completed and the skew of the medium M is eliminated, as shown in FIG. 11. Since the medium M in which the skew is eliminated is fed while being pressed by the pick roller 112 thereafter, it is suppressed that the medium M rotates too much, and thereby is inclined in the reverse direction. Therefore, the medium conveying apparatus 100 can suppress overcorrection of the skew of the medium M.

Figure 12:
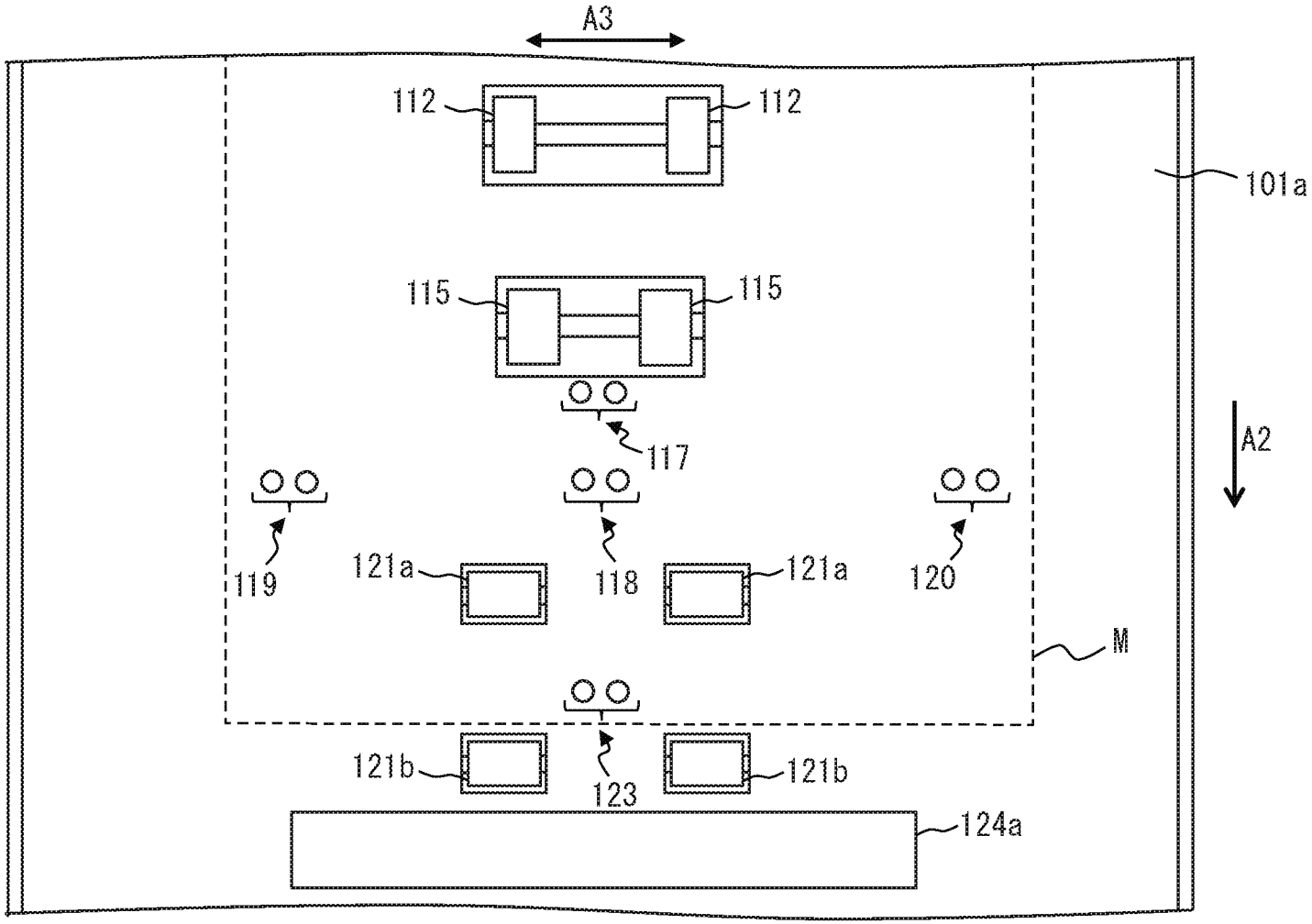
FIG. 12 is a schematic view illustrating a state in which a front end of the medium has passed through a position of a sixth sensor.

FIG. 12 is a schematic view showing a state in which the front end of the medium M shown in FIG. 8 has passed through the position of the sixth sensor 123.

For example, the control module 151 returns the pick roller 112 to the first position when the correction of the skew of the medium M is completed, and further the front end of the medium M passes through the position of the sixth sensor 123, as shown in FIG. 12. Since the medium M in which the skew is eliminated is fed while being pressed by the pick roller 112 thereafter, it is suppressed that the medium M rotates too much, and thereby is inclined in the reverse direction. Therefore, the medium conveying apparatus 100 can suppress overcorrection of the skew of the medium M. In general, a fixed time is required from when the motor 131 is controlled to return the circumferential speed of each feed roller 115 to the reference speed until the circumferential speed of each feed roller 115 is actually changed. The control module 151 can return the pick roller 112 to the medium M at a timing when the correction of the skew of the medium M is more reliably completed, by returning the pick roller 112 when the medium M passes through the position of the sixth sensor 123. Therefore, the control module 151 can prevent that the damage of the medium occurs.

Figure 13:
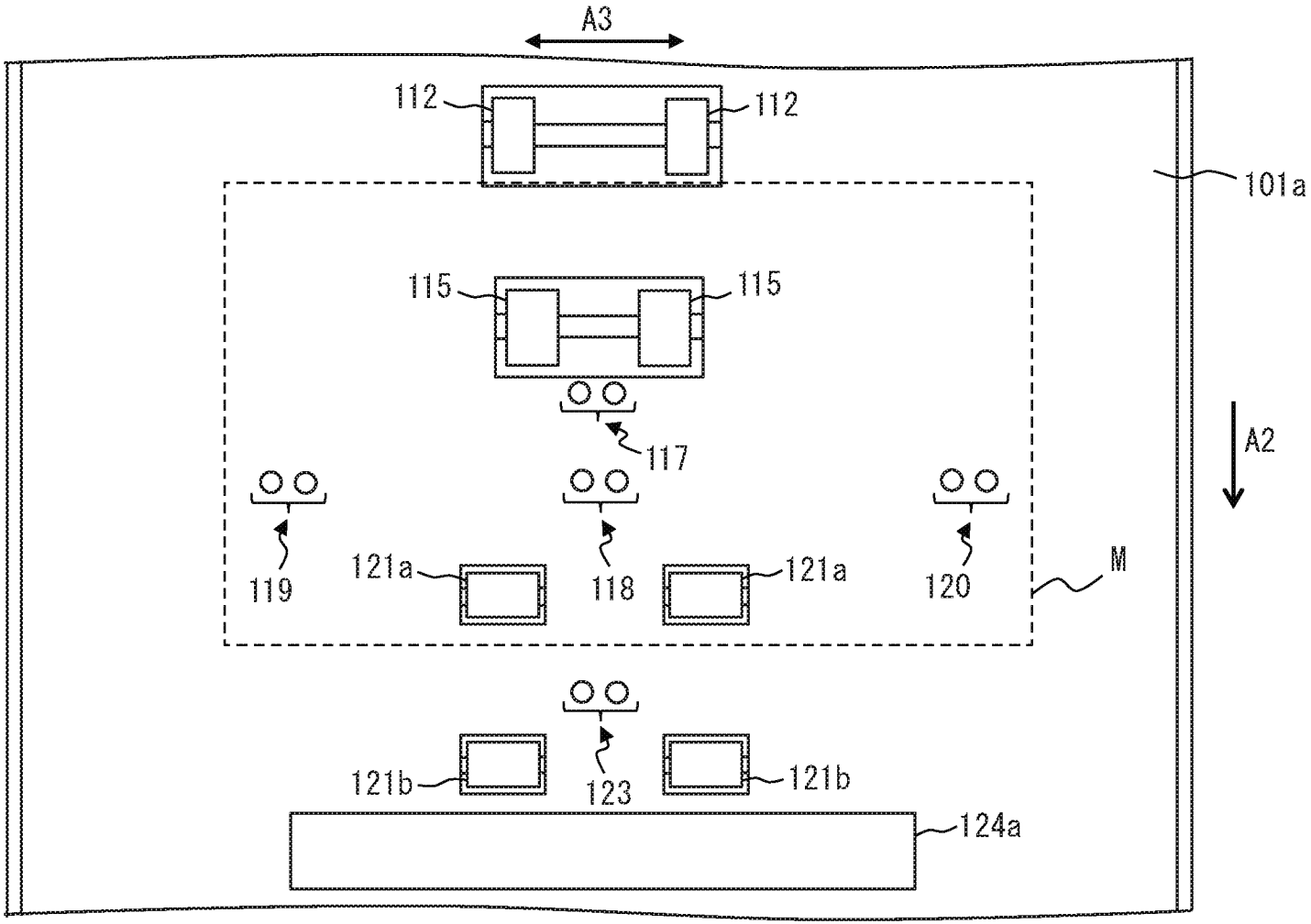
FIG. 13 is a schematic view illustrating a state in which a rear end of the medium has passed through a position of the pick roller.

FIG. 13 is a schematic view illustrating a state in which the rear end of the medium M shown in FIG. 8 has passed through the position of the pick roller 112.

For example, the control module 151 returns the pick roller 112 to the first position when the correction of the skew of the medium M is completed and further the rear end of the medium M passes through the position of the pick roller 112, as shown in FIG. 13. Since the pick roller 112 does not contact the fed medium M, it is suppressed that the feed speed of the medium to be fed next suddenly changes, in particular, that the feed speed is increased, by the load applied to the medium to be fed next through the fed medium M. Therefore, the medium conveying apparatus 100 can suppress the occurrence of the jam of the medium, and a deviation (noise) of the medium in the input image, etc.

As described in detail above, the medium conveying apparatus 100 moves the pick roller 112 which is not used for the correction of the skew of the medium, to be spaced apart from the medium, while correcting the skew of the medium by the feed roller 115, when the skew of the medium is detected. Thus, the medium conveying apparatus 100 can suppress that the load is applied to the medium by the pick roller 112 while the medium is rotated by the feed roller 115, and thereby can satisfactorily correct the skew of the medium.

Further, since the medium conveying apparatus 100 can satisfactorily correct the skew of the medium, the user does not need to align the front end of the medium when setting the medium to the medium tray 103. Therefore, the medium conveying apparatus 100 can improve the convenience of the user.

Figure 14A:
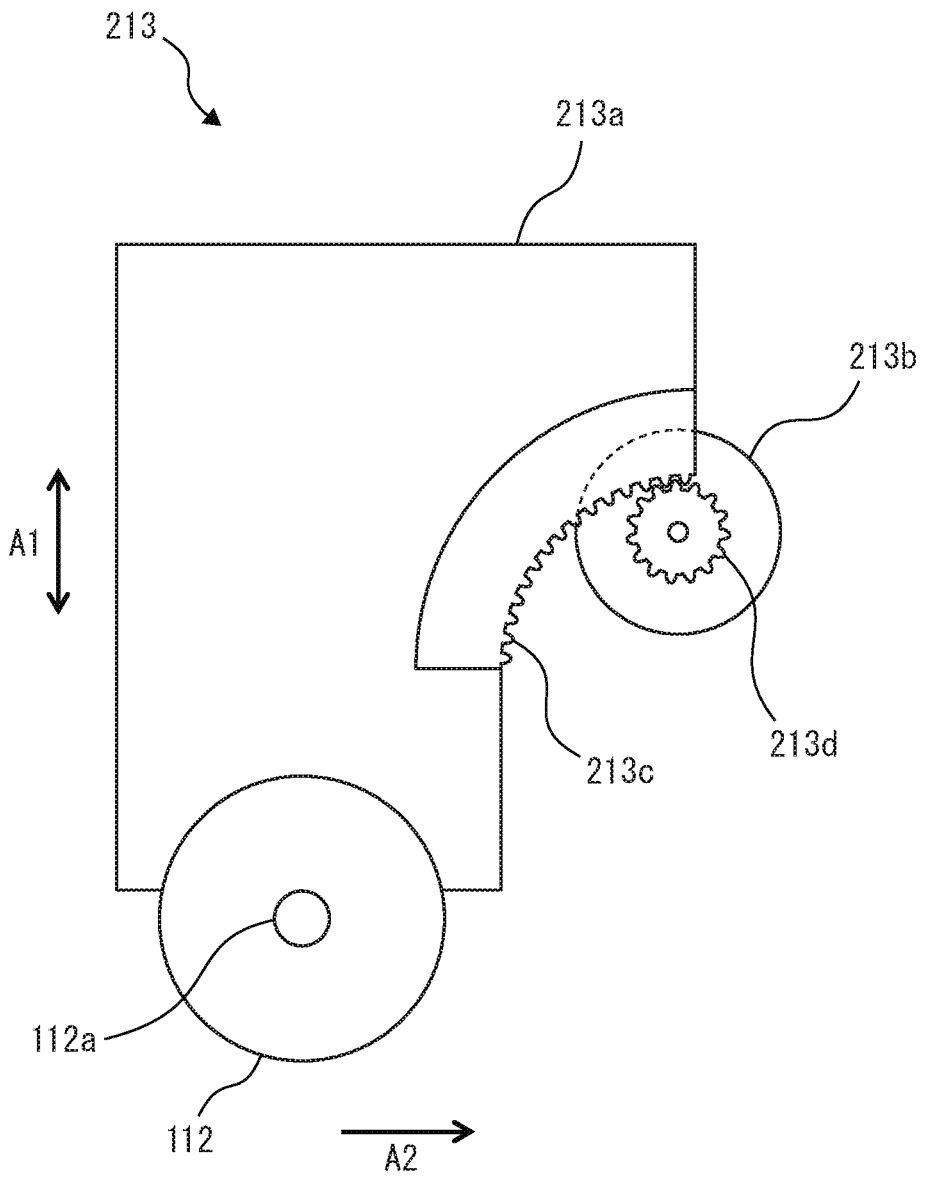
FIG. 14A is a diagram for illustrating another movement mechanism 213.
Figure 14B:
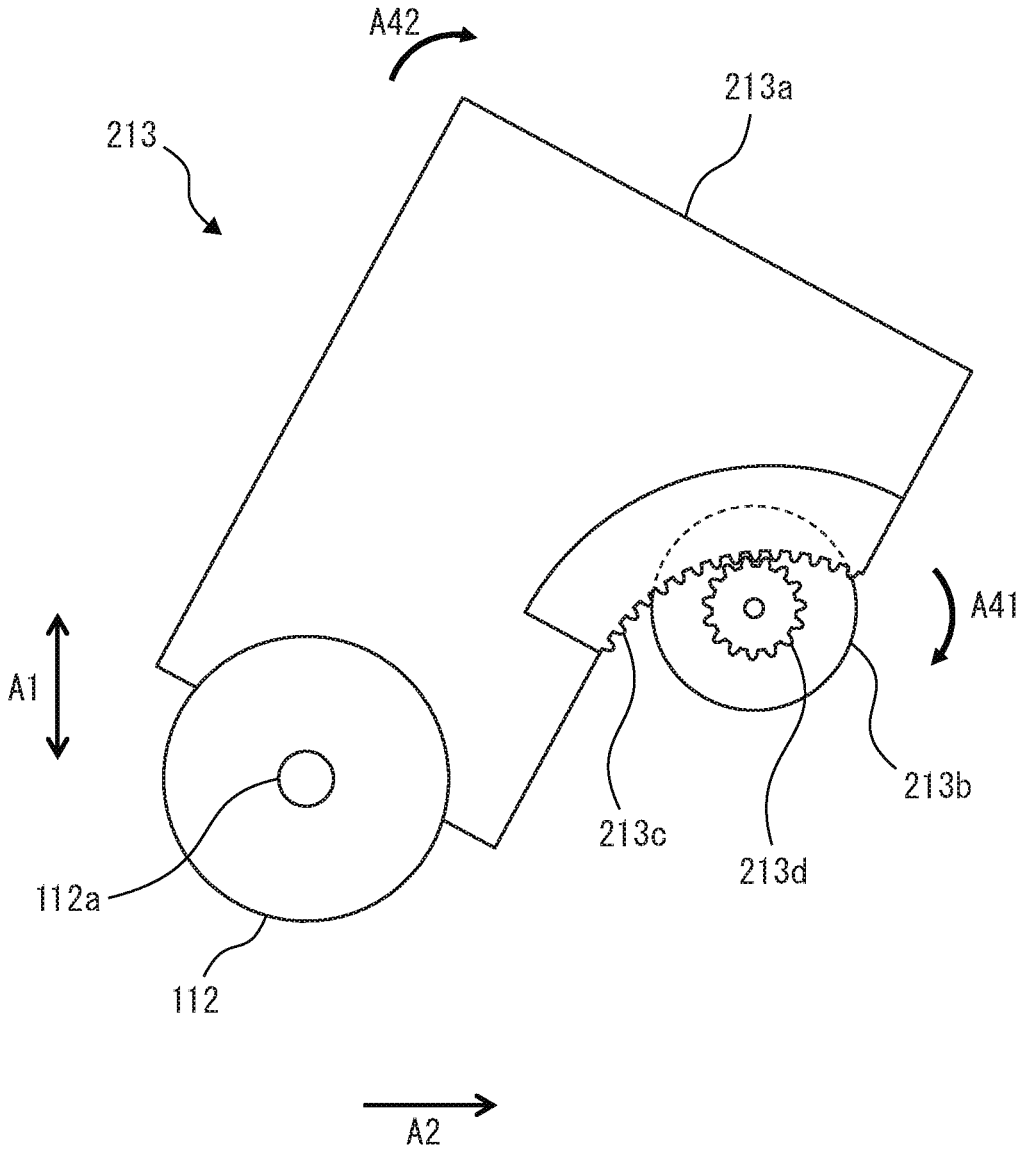
FIG. 14B is a diagram for illustrating the other movement mechanism 213.

FIGS. 14A and 14B are diagrams for illustrating a movement mechanism 213 of a medium conveying apparatus according to another embodiment. FIGS. 14A and 14B are a schematic views of the pick roller 112 and the movement mechanism 213, as viewed from the side of the medium conveying apparatus.

As illustrated in FIG. 14A and FIG. 14B, the movement mechanism 213 is used in place of the movement mechanism 113. The movement mechanism 213 includes a cam member 213*a* and a second motor 213*b*, etc.

The cam member 213*a* is rotatably provided inside the first housing 101 and supports the pick roller 112. The shaft 112*a* being a rotation shaft of the pick roller 112, is attached to one end of the cam member 213*a*. A rack 213*c* is formed on a side portion of the cam member 213*a* so as to extend in an arc shape.

A pinion 213*d* is provided on a rotation shaft of the second motor 213*b* so as to be engaged with and combined with the rack 213*c*. The second motor 213*b* rotates in accordance with a control signal from the processing circuit 150 to rotate the pinion 213*d*.

As illustrated in FIG. 14A, in the initialization, the pick roller 112 attached to the cam member 213*a* is located at the first position in contact with the medium placed on the medium tray 103. On the other hand, as shown in FIG. 14B, when the rotation shaft of the second motor 213*b* rotates in a direction of an arrow A41, the pinion 213*d* rotates in the direction of the arrow A41, the rack 213*c* moves according to the rotation of the pinion 213*d*, and the cam member 213*a* rotates in a direction of an arrow A42. The pick roller 112 moves upward in the height direction A1 according to the rotation of the cam member 213*a*, and is located at a second position spaced apart from the medium placed on the medium tray 103. Thus, the movement mechanism 213 moves the pick roller 112 between the first position in contact with the medium and the second position spaced apart from the medium.

As described in detail above, the medium conveying apparatus 100 can satisfactorily correct the skew of the medium even when using the second motor 213*b* as the movement mechanism.

The medium conveying apparatus may move the feed roller 115 to be spaced apart from the medium while correcting the skew of the medium using the first conveying roller 121*a* when the skew of the medium is detected.

In this case, the feed roller 115 is an example of the first roller, and the first conveying roller 121*a* is an example of the second roller. The movement mechanism 113 or 213 is provided to move the feed roller 115 between the first position in contact with the medium and the second position spaced apart from the medium. The first conveying rollers 121*a* are located apart from each other in the width direction A3 perpendicular to the medium conveying direction, and are provided so as to independently rotate and convey the medium, respectively. The motor 131 includes separate motors to independently rotate the first conveying rollers 121*a*, respectively. The controller 151 corrects the skew of the medium by making the circumferential speeds of the feed rollers 115 vary from each other. The third to fifth sensors 118 to 120 are located on the downstream side of the first conveying roller 121*a* and the upstream side of the sixth sensor 123 in the medium conveying direction A2. The second sensor 117 is located on the downstream side of the first conveying roller 121*a* and on the upstream side of the third to fifth sensors 118 to 120 in the medium conveying direction A2 and between the first conveying rollers 121*a* in the width direction A3. The encoder 114 is located in such a way that at least a part of the encoder 114 is overlapped with the feed roller 115 in the medium conveying direction A2, i.e., at least a part of the encoder 114 is overlapped with the feed roller 115 when viewed from the width direction A3, to detect the conveyance of the medium at the arrangement position of the feed roller 115.

As described in detail above, the medium conveying apparatus can satisfactorily correct the skew of the medium even when the feed roller 115 is moved to be spaced apart from the medium while correcting the skew of the medium using the first conveying roller 121*a*.

Figure 15:
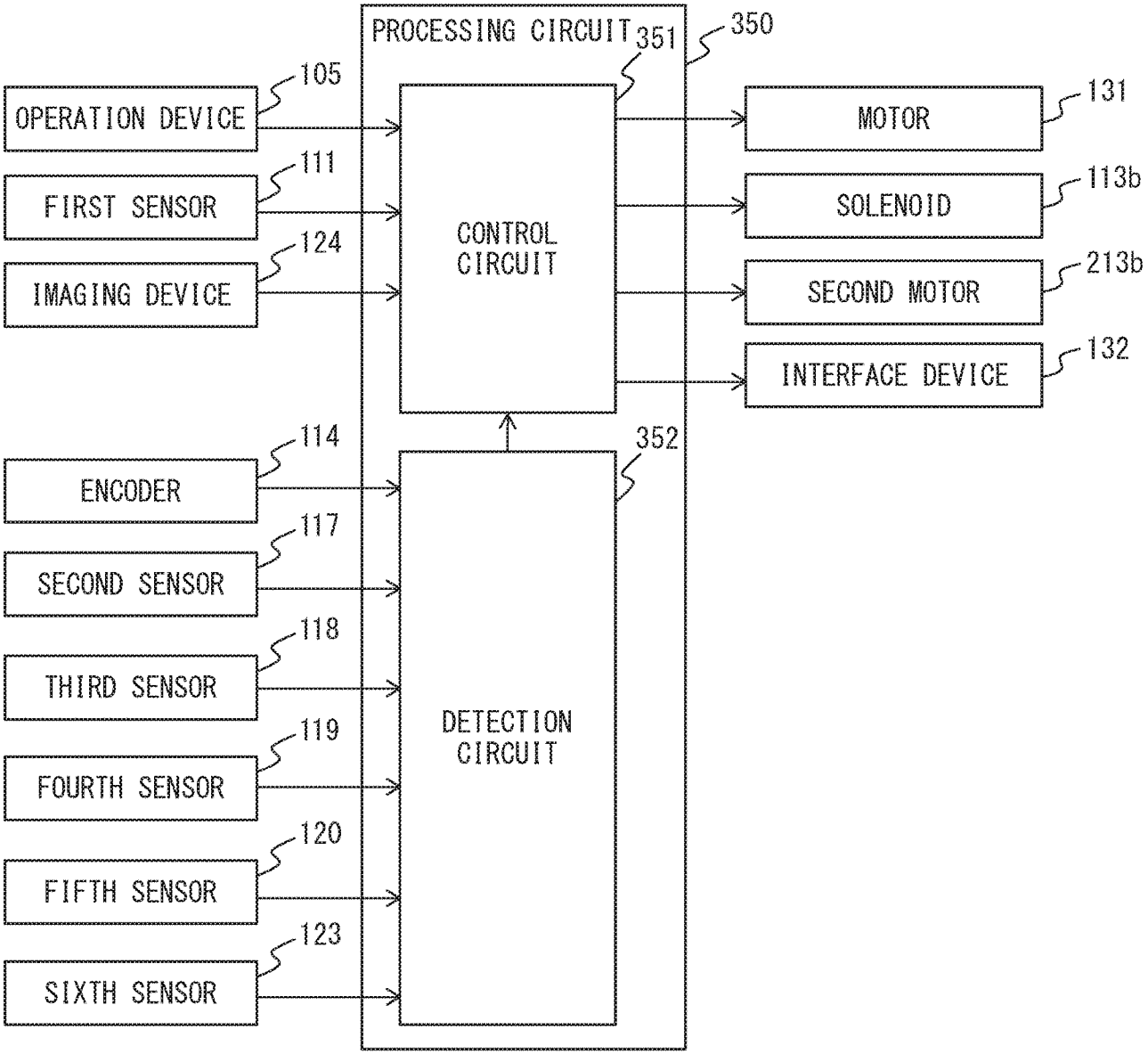
FIG. 15 is a diagram illustrating a schematic configuration of a processing circuit 350 according to another embodiment.

FIG. 15 is a diagram illustrating a schematic configuration of a processing circuit 350 of a medium conveying apparatus according to another embodiment.

The processing circuit 350 is used in place of the processing circuit 150 of the medium conveying apparatus 100 and executes the medium read processing and the correction processing, etc., in place of the processing circuit 150. The processing circuit 350 includes a control circuit 351 and a detection circuit 352, etc. Note that each unit may be configured by an independent integrated circuit, a microprocessor, firmware, etc.

The control circuit 351 is an example of a control module, and has a function similar to the control module 151. The control circuit 351 receives the operation signal from the operation device 105 and the first medium signal from the first sensor 111 and controls the motor 131 to control each roller based on the received signal. The control circuit 351 receives a detection result of the state of the medium including the skew of the medium from the detection circuit 352. The control circuit 351 controls the motor 131 to correct the skew of the medium based on the received detection result, and controls the solenoid 113*b* or the second motor 213*b* to move the pick roller 112 or feed roller 115.

Further, the control circuit 351 acquires an input image from the imaging device 124, and outputs it to the interface device 132.

The detection circuit 352 is an example of a detection module, and has a function similar to the detection module 152. The detection circuit 352 receives the distance signal from the encoder 114 and the second to sixth medium signals from the second to sixth sensors 117 to 120, 123, detects the state of the medium including the skew of the medium based on the received signal, and outputs the detection result to the control circuit 351.

As described in detail above, the medium conveying apparatus can satisfactorily correct the skew of the medium even when the medium reading processing and the correction processing are executed by the processing circuit 350.

According to some embodiments, the medium conveying apparatus, the control method, and the computer-readable, non-transitory medium storing the control program, can satisfactorily correct the skew of the medium.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:

a first roller to convey a medium;

a solenoid or a motor, to move the first roller between a first position in contact with the medium and a second position spaced apart from the medium;

a second roller located on a downstream side of the first roller in a medium conveying direction to convey the medium;

a plurality of first medium sensors located apart from each other in a direction perpendicular to the medium conveying direction and on a downstream side of the second roller;

an imaging device located on a downstream side of the first medium sensors in the medium conveying direction;

a second medium sensor located between the first medium sensors and the imaging device in the medium conveying direction; and a processor to determine whether a skew of the conveyed medium has occurred, and control the solenoid or the motor to move the first roller from the first position to the second position, and execute a correction of the skew of the conveyed medium for orienting a front end of the medium to a downstream side of the medium conveying direction, using the second roller when it is determined that the skew of the conveyed medium has occurred, and control the solenoid or the motor to return the first roller from the second position to the first position so that the first roller is in contact with the conveyed medium the skew of which is corrected after the correction of the skew of the medium is started, for orienting the front end of the medium to the downstream side of the medium conveying direction, wherein the processor determines whether the skew of the conveyed medium has occurred based on output signals from the first medium sensors, and wherein the processor controls the solenoid or the motor to return the first roller to the first position when the conveyed medium passes through a position of the second medium sensor.

2. The medium conveying apparatus according to claim 1, further comprising a medium tray, wherein the first roller is a pick roller to convey the medium placed on the medium tray.

3. The medium conveying apparatus according to claim 1, wherein the second roller is a plurality of feed rollers located apart from each other in a direction perpendicular to the medium conveying direction to feed the medium by rotating independently, respectively, and wherein the processor corrects the skew of the medium by making circumferential speeds of the feed rollers vary from each other.

4. The medium conveying apparatus according to claim 1, wherein the processor controls the solenoid or the motor to move the first roller to the second position when the conveyed medium first passes through a position of any of the first medium sensors.

5. The medium conveying apparatus according to claim 1, wherein the number of the second roller is a plural, further comprising a third medium sensor located on an upstream side of the first medium sensors in the medium conveying direction, and between the second rollers in the direction perpendicular to the medium conveying direction, and wherein the processor controls the solenoid or the motor to move the first roller to the second position when the conveyed medium passes through a position of the third medium sensor.

6. The medium conveying apparatus according to claim 1 wherein the processor controls the solenoid or the motor to return the first roller to the first position when the correction of the skew of the medium is completed.

7. The medium conveying apparatus according to claim 1, further comprising an encoder to detect a conveyance of the medium at an arrangement position of the first roller, wherein the processor controls the solenoid or the motor to return the first roller to the first position when the conveyance of the medium stops.

8. A method for correcting a skew of a medium, comprising:

conveying the medium, by a first roller;

moving the first roller between a first position in contact with the medium and a second position spaced apart from the medium, by a solenoid or a motor;

conveying the medium, by a second roller located on a downstream side of the first roller in a medium conveying direction;

detecting the skew of the conveyed medium, controlling the solenoid or the motor to move the first roller from the first position to the second position, and executing a correction of the skew of the conveyed medium for orienting a front end of the medium to a downstream side of the medium conveying direction, using the second roller when the skew of the conveyed medium is detected, and controlling the solenoid or the motor to return the first roller from the second position to the first position so that the first roller is in contact with the conveyed medium the skew of which is corrected after the correction of the skew of the medium is started, for orienting the front end of the medium to the downstream side of the medium conveying direction, wherein the skew of the conveyed medium is detected based on output signals from a plurality of first medium sensors located apart from each other in a direction perpendicular to the medium conveying direction and on a downstream side of the second roller, and wherein the solenoid or the motor is controlled to return the first roller to the first position when the conveyed medium passes through a position of a second medium sensor located between the first medium sensors and an imaging device located on a downstream side of the first medium sensors in the medium conveying direction.

9. The method according to claim 8, wherein the first roller is a pick roller to convey the medium placed on a medium tray.

10. The method according to claim 8, wherein the second roller is a plurality of feed rollers located apart from each other in a direction perpendicular to the medium conveying direction to feed the medium by rotating independently, respectively, and wherein the skew of the medium is corrected by making circumferential speeds of the feed rollers vary from each other.

11. The method according to claim 8, wherein the solenoid or the motor is controlled to move the first roller to the second position when the conveyed medium first passes through a position of any of the first medium sensors.

12. The method according to claim 8, wherein the number of the second roller is a plural, and wherein the solenoid or the motor is controlled to move the first roller to the second position when the conveyed medium passes through a position of a third medium sensor located on an upstream side of the first medium sensors in the medium conveying direction, and between the second rollers in the direction perpendicular to the medium conveying direction.

13. The method according to claim 8, wherein the solenoid or the motor is controlled to return the first roller to the first position when the correction of the skew of the medium is completed.

14. The method according to claim 8, further comprising detecting a conveyance of the medium at an arrangement position of the first roller by an encoder, wherein the solenoid or the motor is controlled to return the first roller to the first position when the conveyance of the medium stops.

15. A computer-readable, non-transitory medium storing a computer program, wherein the computer program causes a medium conveying apparatus including a first roller to convey a medium, a solenoid or a motor to move the first roller between a first position in contact with the medium and a second position spaced apart from the medium, a second roller located on a downstream side of the first roller in a medium conveying direction to convey the medium, a plurality of first medium sensors located apart from each other in a direction perpendicular to the medium conveying direction and on a downstream side of the second roller, an imaging device located on a downstream side of the first medium sensors in the medium conveying direction, and a second medium sensor located between the first medium sensors and the imaging device in the medium conveying direction, to execute a process, the process comprising:

detecting the skew of the conveyed medium;

controlling the solenoid or the motor to move the first roller from the first position to the second position, and executing a correction of the skew of the conveyed medium for orienting a front end of the medium to a downstream side of the medium conveying direction, using the second roller when the skew of the conveyed medium is detected, and controlling the solenoid or the motor to return the first roller from the second position to the first position so that the first roller is in contact with the conveyed medium the skew of which is corrected after the correction of the skew of the medium is started, for orienting the front end of the medium to the downstream side of the medium conveying direction, wherein the skew of the conveyed medium is detected based on output signals from the first medium sensors, and wherein the solenoid or the motor is controlled to return the first roller to the first position when the conveyed medium passes through a position of the second medium sensor.

16. The computer-readable, non-transitory medium according to claim 15, wherein the medium conveying apparatus further includes a medium tray, and wherein the first roller is a pick roller to convey the medium placed on the medium tray.

17. The computer-readable, non-transitory medium according to claim 15, wherein the second roller is a plurality of feed rollers located apart from each other in a direction perpendicular to the medium conveying direction to feed the medium by rotating independently, respectively, and wherein the skew of the medium is corrected by making circumferential speeds of the feed rollers vary from each other.

18. The computer-readable, non-transitory medium according to claim 15, wherein the solenoid or the motor is controlled to move the first roller to the second position when the conveyed medium first passes through a position of any of the first medium sensors.

19. The computer-readable, non-transitory medium according to claim 15, wherein the number of the second roller is a plural, wherein the medium conveying apparatus further includes a third medium sensor located on an upstream side of the first medium sensors in the medium conveying direction, and between the second rollers in the direction perpendicular to the medium conveying direction, and wherein the solenoid or the motor is controlled to move the first roller to the second position when the conveyed medium passes through a position of the third medium sensor.

20. The computer-readable, non-transitory medium according to claim 15, wherein the solenoid or the motor is controlled to return the first roller to the first position when the correction of the skew of the medium is completed.

* * * * *